US007690751B2

(12) United States Patent
Takabayashi et al.

(10) Patent No.: US 7,690,751 B2
(45) Date of Patent: Apr. 6, 2010

(54) RECORDING HEAD AND RECORDING APPARATUS, AND INSPECTION APPARATUS OF RECORDING HEAD AND METHOD THEREOF

(75) Inventors: Hiroshi Takabayashi, Atsugi (JP); Takatsuna Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 11/748,677

(22) Filed: May 15, 2007

(65) Prior Publication Data

US 2007/0291066 A1 Dec. 20, 2007

(30) Foreign Application Priority Data

Jun. 19, 2006 (JP) ..... 2006-169381

(51) Int. Cl.
*B41J 29/393* (2006.01)
*B41J 29/38* (2006.01)
*B41J 2/05* (2006.01)

(52) U.S. Cl. ..... 347/19; 347/17; 347/67

(58) Field of Classification Search ..... 347/17, 347/19, 67

See application file for complete search history.

(56) References Cited

U.S. PATENT DOCUMENTS 4,550,327 A 10/1985 Miyakawa
4,723,129 A 2/1988 Endo et al.
4,740,796 A 4/1988 Endo et al.
5,175,565 A * 12/1992 Ishinaga et al. ..... 347/67
5,485,179 A * 1/1996 Otsuka et al. ..... 347/14
5,485,182 A * 1/1996 Takayanagi et al. ..... 347/17
5,576,745 A * 11/1996 Matsubara ..... 347/14
5,646,655 A * 7/1997 Iwasaki et al. ..... 347/17
5,745,132 A * 4/1998 Hirabayashi et al. ..... 347/14
5,751,304 A * 5/1998 Hirabayashi et al. ..... 347/17
6,068,363 A * 5/2000 Saito ..... 347/17
6,116,709 A * 9/2000 Hirabayashi et al. ..... 347/14
6,139,125 A * 10/2000 Otsuka et al. ..... 347/11
6,193,344 B1 * 2/2001 Otsuka et al. ..... 347/11
6,224,182 B1 * 5/2001 Nagoshi et al. ..... 347/19
6,464,318 B2 10/2002 Kubo
6,582,065 B1 * 6/2003 Okazaki et al. ..... 347/65
7,048,351 B2 * 5/2006 Kawatoko ..... 347/19
7,275,798 B2 * 10/2007 Im ..... 347/19
7,510,255 B2 * 3/2009 Tamura et al. ..... 347/17

FOREIGN PATENT DOCUMENTS

JP 02-019321 A 1/1990
JP 04-006549 A 1/1992
JP 04-006549 B 2/1992

(Continued)

*Primary Examiner*—Julian D Huffman
(74) *Attorney, Agent, or Firm*—Canon U.S.A., Inc. I.P. Division

(57) ABSTRACT

A temperature detection circuit acquires first temperature data detected by a temperature sensor corresponding to a heater of a recording head in a state in which no electric current is flowed into the heater, and second temperature data for the heater in a state in which an electric current is flowed into the heater. Correction data for correcting the temperature data detected by the temperature sensor is obtained based on the first and second temperature data. The temperature data detected by the temperature sensor is corrected based on the correction data.

6 Claims, 21 Drawing Sheets

FOREIGN PATENT DOCUMENTS

| | | | |
|---|---|---|---|
| JP | 07-052408 | A | 2/1995 |
| JP | 08-295021 | A | 11/1996 |
| JP | 11-138788 | A | 5/1999 |
| JP | 2002-079656 | A | 3/2002 |
| JP | 2002-178492 | A | 6/2002 |

* cited by examiner

FIG. 21

| ROOM TEMPERATURE REFERENCE VALUE $T_a$ | ELECTRICAL MISALIGNMENT | | INCREASED TEMPERATURE REFERENCE VALUE $T_G$ | OVERALL MISALIGNMENT | |
|---|---|---|---|---|---|
| | MEASURED VALUE | $T_{Eoff}$ | | MEASURED VALUE | K |
| 40℃ | 37℃ | −3℃ | 160℃ | 145.3℃ | 0.9 |
| | 40℃ | ±0℃ | | 160℃ | 1.0 |
| | 43℃ | +3℃ | | 175.3℃ | 1.1 |
| 25℃ | 22℃ | −3℃ | 150℃ | 134.8℃ | 0.9 |
| | 25℃ | ±0℃ | | 150℃ | 1.0 |
| | 28℃ | +3℃ | | 165.8℃ | 1.1 |
| 10℃ | 22℃ | −3℃ | 140℃ | 134.8℃ | 0.9 |
| | 10℃ | ±0℃ | | 140℃ | 1.0 |
| | 28℃ | +3℃ | | 165.8℃ | 1.1 |

RECORDING HEAD AND RECORDING APPARATUS, AND INSPECTION APPARATUS OF RECORDING HEAD AND METHOD THEREOF

BACKGROUND OF THE INVENTION

1. Field of the Invention

The invention relates to a recording head and a recording apparatus, which applies thermal energy to a liquid and discharges the liquid through a nozzle, and an inspection apparatus of the recording head and a method thereof.

2. Description of the Related Art

An inkjet recording apparatus, e.g., an inkjet printer, prints a variety of types of data by discharging ink through nozzles that are built into a recording head, e.g., an inkjet head, thus causing the ink to adhere to a sheet of printing paper or other recording material. Such an inkjet printer has many advantages, including making little noise, being capable of high-speed printing, and being usable with a wide range of recording material. Among the inkjet heads, a type of inkjet head that applies thermal energy to the ink when discharging the ink through the nozzle has such advantages as being very responsive to a print signal and lending itself easily to high-density integration (see U.S. Pat. No. 4,723,129 and U.S. Pat. No. 4,740,796).

The inkjet printer that uses such an inkjet head, on the other hand, is prone to experiencing a discharge malfunction with some or all of the inkjet heads, whether due to the nozzle being clogged by a foreign substance, an air bubble interfering with an ink supply path, or a change in a wetness level (wettability) of a nozzle surface, among other causes. Particularly where high-speed printing is concerned, when using a full-line type of inkjet head, upon which is mounted a plurality of nozzles, corresponding to a full width of the recording material, an important issue that has emerged is that of identifying the nozzle among the plurality of nozzles where the discharge malfunction has occurred, providing for compensation of a portion of an image corresponding to the malfunctioning nozzle, and taking the compensation into account in a recovery process of the inkjet head. The inkjet printer that employs such an inkjet head also suffers from a situation wherein a quantity of ink that is discharged from each respective nozzle may change in conjunction with a temperature change in the inkjet head, and a density of the printed image will not be reliable. It is particularly crucial where the full-line type of inkjet head is concerned to curb a degradation of the image that might result from such a change in the quantity of ink discharged.

In view of the foregoing crucial factors, a variety of types of methods for detecting when the ink is not being discharged, compensating for failure to discharge, control methods and apparatuses, and a variety of methods for controlling the quantity of ink discharged have long been promulgated.

Japanese Examined Patent Publication No. H04-006549 discloses a method that detects, in an ink discharge source, whether or not the ink is being discharged. According to the document, a conductor, the resistance thereof changes in response to heat, is placed in a position from which it can detect the heat that is emitted by an electrothermal transducer, i.e., a heater, and an application of the discharge signal to the electrothermal transducer controlled in response to a change in temperature as signified by a degree of change in a value of the resistance of the conductor.

Another method that detects, in an ink discharge source, whether or not the ink is being discharged is disclosed in Japanese Patent No. 2,831,778, wherein is disclosed an inkjet heard wherein the electrothermal transducer (heater) and a temperature sensor are both mounted on a silicon wafer or other support, and a temperature sensor that is configured of a film is overlaid with an array region of the electrothermal transducer. Japanese Patent No. 2,831,778 further discloses that the array region of the heaters is completely contained within an array region of the temperature sensor, which in turn is positioned as an overlay of the array of the heaters, thus improving the precision and the responsiveness of the detection and the control of the temperature.

Japanese Patent Laid Open No. 2002-178492 discloses a technique of detecting a temperature attribute of the inkjet head by determining a threshold value of detecting a remaining quantity of the ink in accordance with the temperature change that occurs when a specified energy is applied to a heater of the inkjet head.

As a proposal concerning each respective type of discharge malfunction determination criterion or condition for the purpose of improving the precision of the temperature detection, it has been suggested that the inkjet head be protected from an excessive increase in heat, for example, and performing a high-precision detection of a discharge malfunction. According to the proposal, Japanese Patent Laid Open No. H07-052408, a ranking of the inkjet head is performed according to a value of a resistance of a dummy resistor, and the determination condition of whether or not a discharge malfunction has occurred is changed according to the ranking.

As an inspection method that detects an ink discharge status of the inkjet head, there is an inspection method disclosed in Japanese Patent Laid Open No. H11-138788, wherein a temperature increase and a temperature decrease are measured commensurate with a level of heat increase that does not allow the ink discharge, and the temperature increase and the temperature decrease of the inkjet head are measured on a timing different from a timing of a print operation, pertaining to a preparatory ink discharge. If the ink discharge malfunctions, the temperature increase and the temperature decrease of the inkjet head are measured, a heat attribute of the inkjet head is provisionally obtained according to a print status monitoring step, and a determination is made as to whether or not the ink is being properly discharged from the inkjet head, in accordance with a result of a comparison of the measurements.

Neither Japanese Examined Patent Publication No. H04-006549 nor Japanese Patent No. 2,831,778 disclose specifying the position of each respective nozzle of a discharge malfunction. Nor is each respective detection circuit that detects the degree of change in the value of the resistance according to the heat that is emitted by the electrothermal transducer made clear. Consequently, it is not possible to identify the nozzle that is experiencing the discharge malfunction.

The conventional examples of Japanese Patent Laid Open Nos. 2002-178492, H07-052408 and H11-138788 do not disclose a technique of detection pertaining to multiple nozzles, given that they focus on detecting the discharge malfunction on a per inkjet head basis. Accordingly, there is no mention of identifying the malfunctioning nozzle of the inkjet head. Given that the threshold is computed solely from a detected thermal attribute, no consideration has been given to a precision in detection that corresponds to an electrical attribute or a plurality of different thermal attributes. The inkjet printer in Japanese Patent Laid Open No. H07-052408 employs a ranking based on the heater attribute of the dummy resistance. The ranking substitutes a select thermal attribute with the electrical attribute, however, and thus, does not have the improvement of improving the precision in detection based on the detected value of the thermal attribute as its objective.

Therefore, it would be desirable to solve the foregoing problems indigenous to the conventional technology.

SUMMARY OF THE INVENTION

According to an aspect of the present invention, a technology is offered that corrects the temperature data that is detected by the temperature sensor that corresponds to each respective nozzle of a recording head, and corrects an electrical or a thermal misalignment in each respective temperature sensor.

According to another aspect of the present invention, a technology is offered that appropriately determines a timing for detecting an occurrence of a fault in each respective nozzle of the recording head, and detects whether or not a fault is present in the recording head, according to the timing.

According to an aspect of the present invention, there is provided a recording apparatus for recording an image using a recording head that affects ink with thermal energy from a plurality of electrothermal transducers to discharge the ink via a nozzle. The recording head includes a plurality of temperature sensors, each of which is respectively positioned in correspondence with each electrothermal transducer; and a temperature detection circuit configured to select each one of the plurality of temperature sensors and obtain temperature data detected by the selected temperature sensor. The recording apparatus includes a first temperature detection unit, in a state that a first electrothermal transducer is not driven with an electric current, configured to obtain first temperature data that the temperature sensor corresponding to the first electrothermal transducer detects by way of the temperature detection circuit; a second temperature detection unit, in a state that the first electrothermal transducer is driven with an electric current, configured to obtain second temperature data that the temperature sensor corresponding to the first electrothermal transducer detects by way of the temperature detection circuit; an acquisition unit that acquires correaction data for correcting the temperature data that the temperature sensor corresponding to the first electrothermal transducer detects, based on the first and the second temperature data obtained by the first and second temperature detection units; and a correaction unit configured to correct the temperature data that the temperature sensor corresponding to the first electrothermal transducer detects, in accordance with the correaction data acquired by the acquisition unit.

According to another aspect of the present invention, a recording head is provided for affecting ink with thermal energy from an electrothermal transducer to discharge the ink via a nozzle. The recording head includes a plurality of temperature sensors, each of which is respectively positioned in correspondence with each electrothermal transducer; a temperature detection circuit configured to select each of the plurality of temperature sensors, and obtain respective temperature data detected by the selected temperature sensor; a storage unit configured to store correaction data for correcting the temperature data detected by each of the plurality of temperature sensors; and a correaction unit configured to correct the temperature data detected by each of the plurality of temperature sensor in accordance with the correaction data stored in the storage unit.

Moreover, according to another aspect of the present invention a method is provided of inspecting a recording head for affecting ink with thermal energy from an electrothermal transducer to discharge the ink via a nozzle. The method includes flowing an electric current into a first electrothermal transducer and acquiring temperature data detected by a temperature sensor that is arranged in the recording head in correspondence with the first electrothermal transducer; detecting a first timing when the acquired temperature data reaches a peak temperature; detecting a second timing when a temperature change arises in conjunction with a shrinkage in a bubble that has emerged; setting each threshold for serving as a reference for determining whether or not a malfunction occurs at the first and second timings; and determining a driving status of the first electrothermal transducer based on the temperature data detected at the first and second timings by the temperature sensor corresponding to the first electrothermal transducer.

Furthermore, according to another aspect of the present invention, a device is provided for inspecting a recording head for affecting ink with thermal energy from an electrothermal transducer to discharge the ink via a nozzle. The device includes a measurement unit configured to flow an electric current into a first electrothermal transducer and acquire a temperature data detected by a temperature sensor that is respectively positioned in the recording head in correspondence with the first electrothermal transducer; a first detection unit configured to detect a first timing when the acquired temperature data reaches a peak temperature; a second detection unit configured detect a second timing when a temperature change arises in conjunction with a shrinkage in a bubble that has emerged; a setting unit configured to set each threshold for serving as a reference for determining whether or not a malfunction occurs at the first and second timings; and a determination unit configured to determine a driving status of the first electrothermal transducer, based on the temperature data detected at the first and second timings by the temperature sensor corresponding to the first electrothermal transducer.

Further features and aspects of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 21 depicts a view explaining the electrical misalignment and an overall misalignment that are stored in a correaction unit, according to the third embodiment.

DESCRIPTION OF THE EMBODIMENTS

Various embodiments of the present invention will now herein be described below in detail with reference to the accompanying drawings.

First Exemplary Embodiment

FIGS. 1-4 describe an inkjet head and a relationship between the inkjet head, a driving circuit thereof, and an inkjet printer, according to the embodiment. Following is an overall description, concurrent with a description of a configuration of each respective component, with reference to the drawings.

Figure 1:
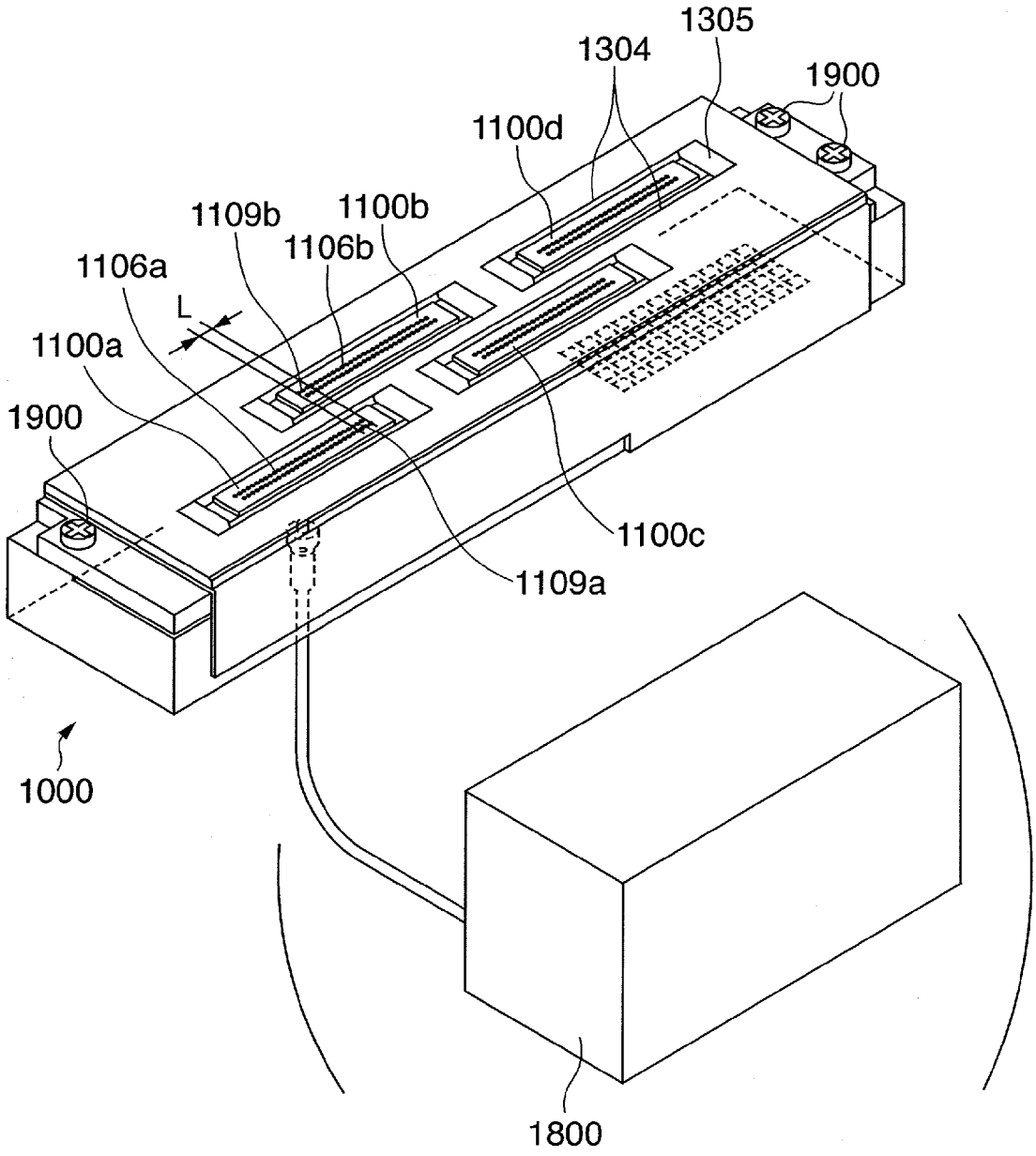
FIG. 1 depicts a view illustrating an example inkjet head according to an embodiment.
Figure 2:
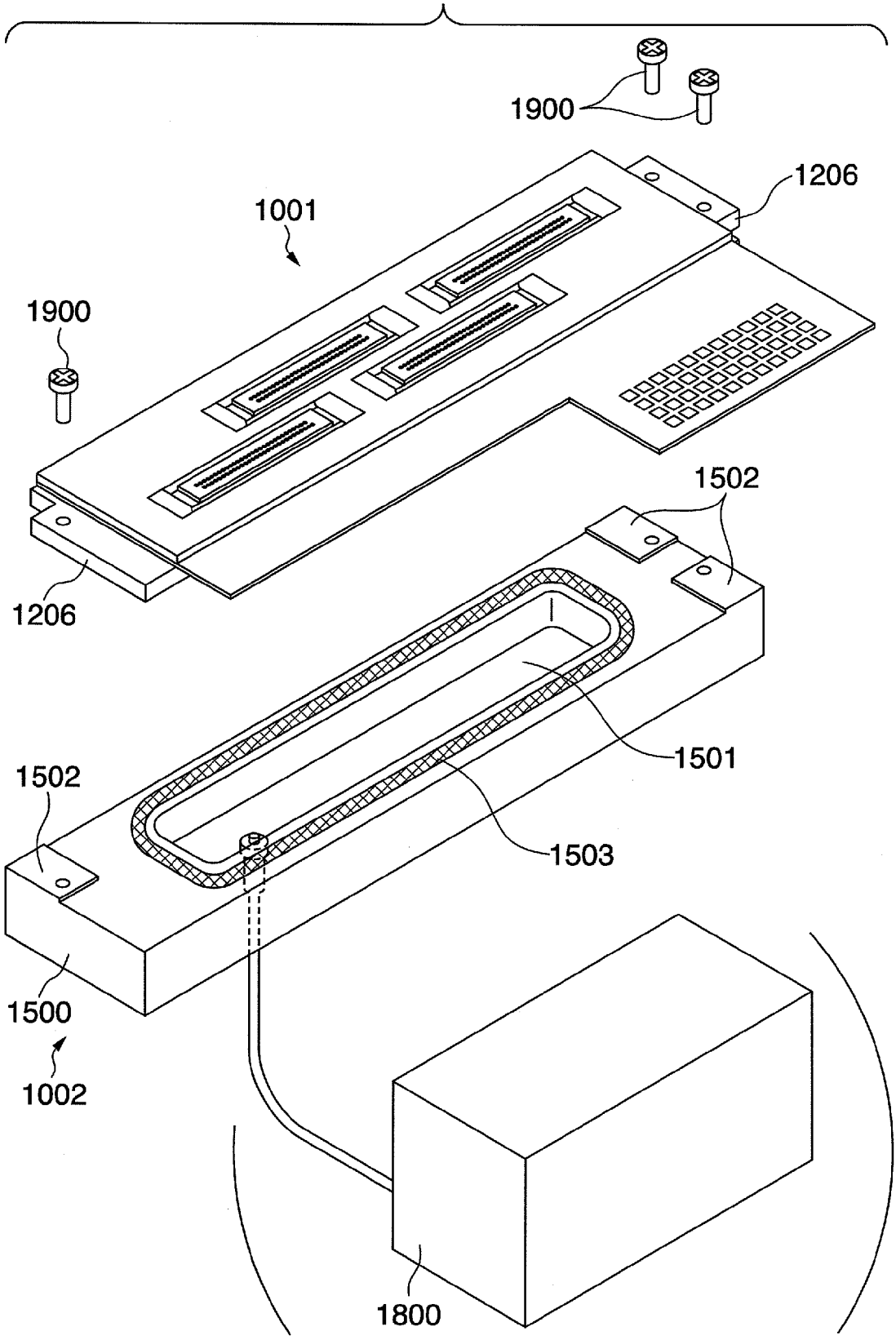
FIG. 2 depicts an oblique cutaway view of the inkjet head depicted in FIG. 1.

FIG. 1 depicts a view illustrating an inkjet head according to the embodiment; while FIG. 2 depicts an oblique cutaway view of the inkjet head depicted in FIG. 1.

An inkjet head 1000 takes a format of performing a recording by causing heat in response to an electrical signal, applying the heat to an ink, and causing a film boiling in the ink to occur. As depicted in FIG. 2, the inkjet head 1000 includes a recording element unit 1001 and an ink supply member 1500 of an ink supply unit 1002. Reference numeral 1800 denotes an ink tank, wherein each respective color of ink is accumulated.

Figure 3:
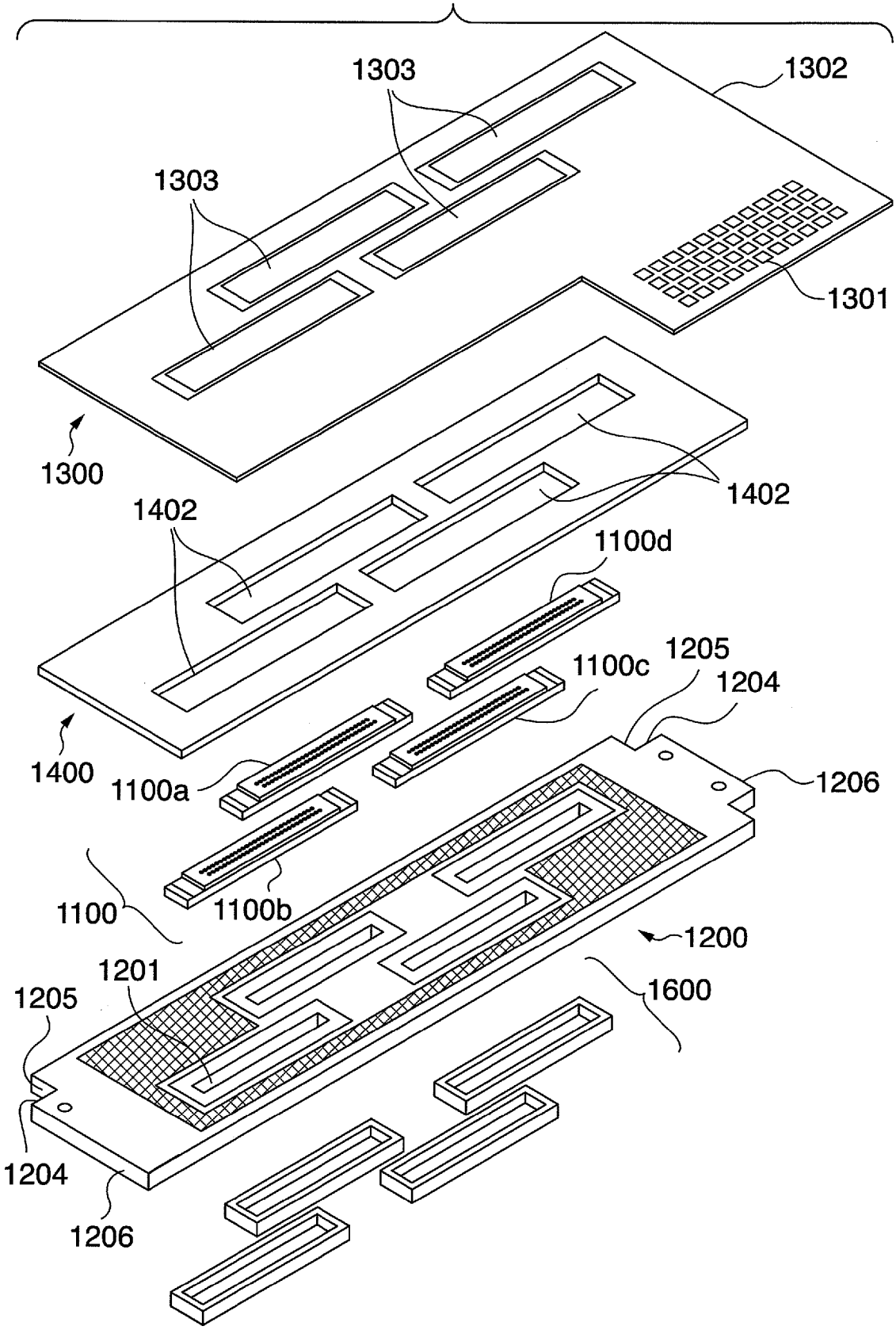
FIG. 3 depicts an oblique cutaway view of an example recording element unit.

FIG. 3 depicts an oblique cutaway view of the recording element unit 1001 shown in FIG. 2. The recording element unit 1001 includes a recording element board 1100, a first plate 1200, an electric wiring board 1300, a second plate 1400, and a filter member 1600.

Figure 4A:
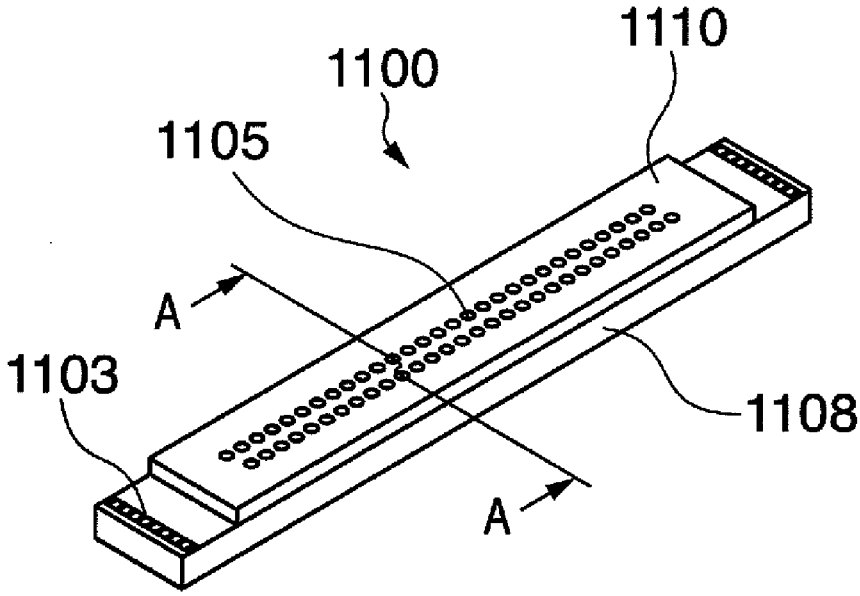
FIG. 4A depicts a view illustrating an example configuration of a recording element board.
Figure 4B:
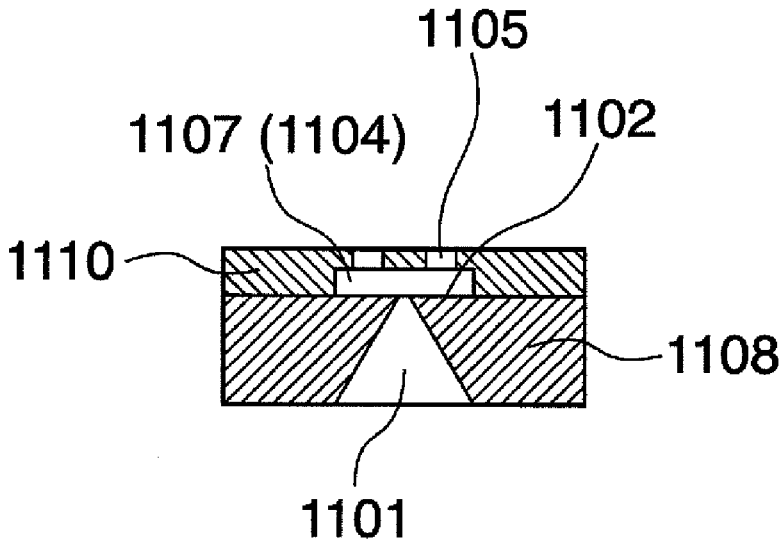
FIG. 4B depicts a cross-section view of the section labeled A-A in FIG. 4A.

FIG. 4A depicts a view illustrating a configuration of the recording element board 1100. FIG. 4B depicts a cross-section view of a section labeled A-A in FIG. 4A.

The recording element board 1100 is formed of a silicon wafer 1108, with a thickness of between about 0.5 mm and 1 mm, and an electrothermal transducer, i.e., a heater, from a thin film, for example. As an ink passage, an ink supply opening 1101 is formed from a penetrating opening, as depicted in FIG. 4B, and an electrothermal transducer 1102 is arrayed in a staggered fashion, one each along either side of the ink supply opening 1101. The electrothermal transducer 1102 and an aluminum or other electrical wiring are formed by a deposit technology. An electrode 1103, as depicted in FIG. 4A, is included in order to supply electricity to the electrical wiring. The ink supply opening 1101 is formed by using a crystal orientation of the silicon wafer 1108 to perform an anisotropic etching. If a wafer surface has a crystal orientation of [100] (indicating Miller indices), and a thickness has a crystal orientation of [111] (indicating Miller indices), an alkali anisotropic etching, i.e., KOH, TMAH, or hydrazine, among other possibilities, will proceed at an angle of approximately 54.7 degrees. Employing the anisotropic etching method forms the ink supply opening 1101 with a desired depth.

As depicted in FIG. 4B, a nozzle plate 1110 is positioned atop the silicon wafer 1108, and an ink passage 1104, a nozzle 1105, and a bubbling chamber 1107 are formed through photolithography. The nozzle 1105 is placed such that it is in opposition to the electrothermal transducer 1102. The ink that is supplied via the ink supply opening 1101 is heated and made to bubble by the heat of the electrothermal transducer 1102, and discharged via each respective nozzle 1105.

A first plate 1200 is formed from aluminum oxide ($Al_2O_3$) between 0.5 mm and 10 mm in thickness, for example. The raw material of the first plate 1200 is not limited to aluminum oxide. It may be made from any material possessing a coefficient of linear expansion that is equivalent to the coefficient of linear expansion of the material of the recording element board 1100, and a coefficient of heat conductivity that is equivalent to, or higher than, the coefficient of heat conductivity of the recording element board 1100. The raw material of the first plate 1200 may be any of silicon (Si), aluminum nitride (AlN), zirconia, Silicon Nitride ($si_3N_4$), silicon carbide (SiC), molybdenum (Mo), or tungsten (W), for example. An ink supply opening 1201 is formed in the first plate 1200, in order to supply the ink to the recording element board 1100, wherein the ink supply opening 1101 corresponds to the ink supply opening 1201, and the recording element board 1100 is fitted and locked in place with a high degree of positional precision vis-à-vis the first plate 1200. It is desirable that an adhesive material that is used therefore have a low degree of viscosity, a thin adhesive layer, which forms a contact surface, a comparatively large degree of hardness after setting, and be ink-repellent, for example. It is desirable that the adhesive be a thermosetting adhesive, composed primarily of an epoxy resin, or a dual ultraviolet setting thermosetting adhesive, with the adhesive layer of not more than 50 [m in thickness, for example. The first plate 1200 possesses an X-directional reference 1204, a Y-directional reference 1205, and a Z-directional reference 1206, which serve as a criterion for determining a position.

The recording element boards 1100 (1100*a* through 100*d*) are positioned in a staggered form on the first plate 1200, making wide printing with a single color possible, as depicted in FIG. 1 and FIG. 2. For example, a length of a nozzle group, one inch plus α, positions the four recording element boards 1100*a*, 1100*b*, 1100*c*, and 1100*d*, in a staggered form, allowing printing across a four-inch width. An edge portion of the respective nozzle groups of the recording element boards forms a region L wherein the edge portions of the nozzle groups of the recording element boards that contact one another in a staggered arrangement overlap in a direction of a print. Accordingly, a gap is prevented from occurring in the print region formed by each respective recording element board. For example, overlapped areas 1109*a* and 1109*b* are respectively formed in a nozzle group 1106*a* and a nozzle group 1106*b*.

The electric wiring board 1300 depicted in FIG. 3 applies an electric signal to cause the recording element board 1100 to discharge the ink. The electric wiring board 1300 possesses four of an aperture unit 1303 into which are embedded the recording element board 1100, and the second plate 1400 is fastened to the back. The electric wiring board 1300 also possesses an electrode terminal 1302 that corresponds to the electrode 1103, as depicted in FIG. 4A, of the recording element board 1100, as well as a signal input terminal 1301, which is positioned at the wire terminal, in order to receive the electrical signal from a main body of the inkjet printer. The electric wiring board 1300 and the recording element board 1100 are connected electrically to one another. The connection method might be, for example, employing a gold wire (not shown) to connect the electrode 1103 of the recording element board 1100 to the electrode terminal 1302 of the electric wiring board 1300 via a wire bonding technology. As a raw material of the electric wiring board 1300, a dual layer flexible wiring board might be used, for example, with an upper surface covered with a polyimide film.

The second plate 1400 is formed from an SUS board with a thickness of about between 0.5 mm and 1 mm, for example. A raw material of the second plate 1400 is not limited to the SUS, and any material may be used that possesses ink repellency and a suitable flatness. The second plate 1400 possesses the recording element board 1100 and an aperture 1402 into which the recording element board 1100 is embedded, and the second plate 1400 is fastened to the first plate 1200. A channel unit that is formed from the aperture 1402 of the second plate 1400 and a side of the recording element board 1100 is filled with a first sealing material 1304, as depicted in FIG. 1, which seals an electrical mounting unit of the electric wiring board 1300. The electrode 1103, as depicted in FIG. 4A, of the recording element board is sealed with a second sealing material 1305, as depicted in FIG. 1, which protects an electrical connection component from corrosion by ink or an exterior shock. The ink supply opening 1201 that is on the back side of the first plate 1200 has a filter material 1600, as depicted in FIG. 3, adhesively fastened thereto, in order to remove a foreign substance that may be mixed in with the ink.

The ink supply member 1500 depicted in FIG. 2 may be formed from a resin cast mold, and is equipped with a common ink chamber 1501 and a Z-directional reference 1502, for example. The Z reference 1502 determines the position of the recording element unit 1001 and fastens the recording element unit 1001 in place, as well as serving as a Z reference of the inkjet head 1000.

As depicted in FIG. 2, the inkjet head 1000 is formed by integrating the recording element unit 1001 with the ink supply member 1500. A flange of the common ink chamber 1501 of the ink supply member 1500 and the recording element unit 1001 are sealed with a third sealing material 1503, making the common ink chamber 1501 airtight. The Z reference 1206 of the recording element unit 1001 has a position determined within the Z reference 1502 of the ink supply member 1500, and is fastened with a screw 1900 or other device, for example. It is desirable that the third sealing material 1503 be ink-repellent, harden at room temperature, and be sufficiently flexible to resist a linear expansion differential between a varying type of material. The signal input terminal 1301 of the recording element unit 1001 has a position determined on the back of the ink supply member 1500, for example, and fastened in place.

Figure 5A:
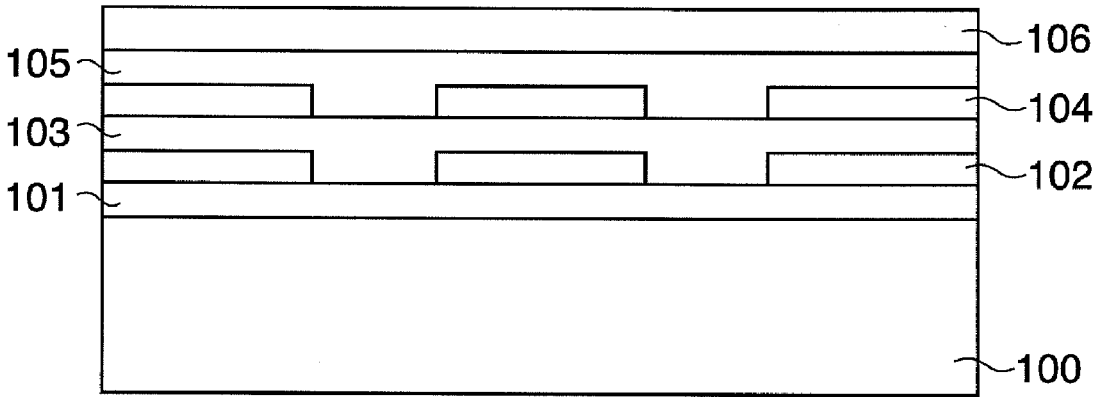
FIG. 5A and FIG. 5B depict a cross-section view and a diagram, respectively, of the recording element unit of the inkjet head according to the embodiment, with the nozzle omitted.
Figure 5B:
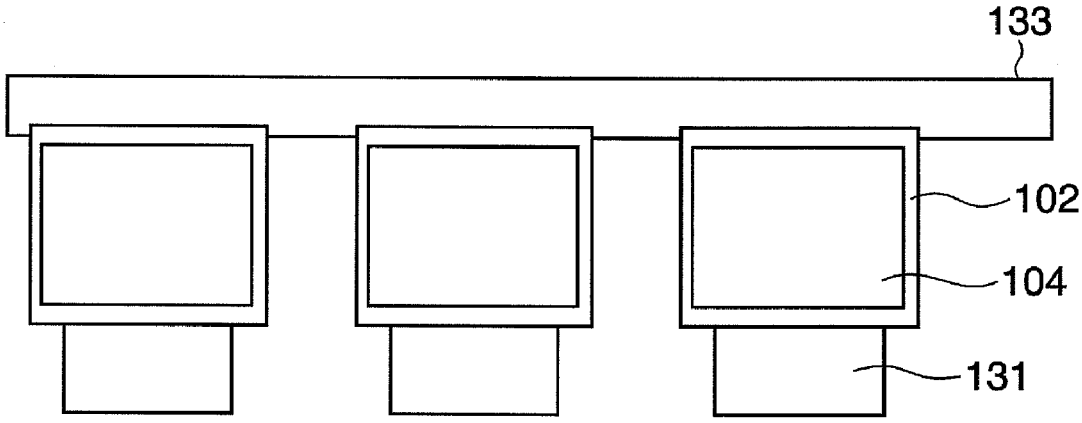

FIG. 5A and FIG. 5B depict a cross-section view and a diagram, respectively, of the recording element unit 1001 of the inkjet head according to the embodiment, with the nozzle omitted.

A silicon wafer 100, which corresponds to the silicon wafer 1108 depicted in FIG. 4B, has a temperature detection element, i.e., a sensor, that is formed from a thin film resistance, that may be composed of Al, Pt, Ti, TiN, TiSi, Ta, TaN, TaCr, Cr, CrSiN, or W, among other possibilities, via a thermal storage layer 101 that may be composed of a thermal oxide film SiO2, among other possibilities. Reference numeral 131 denotes a wire, which may be made of aluminum, among other possibilities, for connecting to each respective temperature sensor 102. Numeral 133 denotes a common wire that connects in common to the temperature sensor 102. An electrothermal transducer 104, of TaSiN or other material, which corresponds to the electrothermal transducer 1102 depicted in FIG. 4B, is formed of a passivation film 105 that is made of $SiO_2$ or other substance, by way of the interlayer insulation film. A protective film 106, which may be made of Ta or other substance, is formed by being layered in a high density with a semiconductor process, in order to reduce an effect of cavitation.

The temperature sensor 102, which is formed by the thin film resistance, is positioned directly below each respective electrothermal transducer 104, separate and isolated therefrom. The wire 131 and the common wire 133, to which are connected each respective temperature sensor 102, are configured as a component of a detection circuit that obtains the temperature data that is detected by each respective temperature sensor 102.

The silicon wafer 100 is formed with an aluminum wire that connects a control circuit that is formed of the electrothermal transducer 104 and the silicon wafer 100, via the thermal storage layer 101 that may be composed of a thermal oxide film SiO2, among other possibilities. The protective film 106, which may be made of Ta or other substance, is formed by being layered in a high density with a semiconductor process, in order to reduce an effect of cavitation of the electrothermal transducer, atop the electrothermal transducer 104, of TaSiN or other material, the passivation film 105 that is made of $SiO_2$ or other substance, by way of the interlayer insulation film 103. It is possible to form a film and pattern the temperature sensor 102 that is formed of the thin film resistance and the wire 131 and the common wire 133, of aluminum or other material, for the connecting wiring, atop the thermal storage layer 101, and thus, production thereof is possible without a significant alteration of an existing production process. A significant advantage is thus obtained in an industrial manufacturing term as well.

Figure 6:
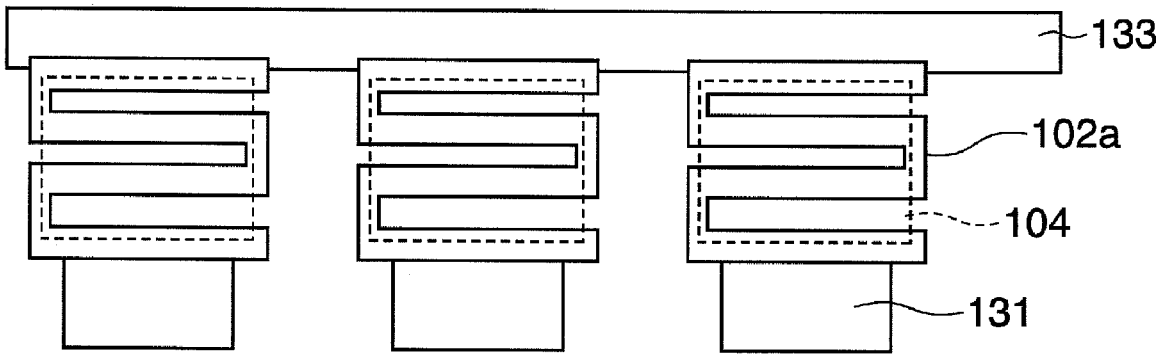
FIG. 6 depicts a plane view illustrating an example temperature sensor according to another embodiment of the present invention.

FIG. 6 depicts a view illustrating a form of the temperature sensor according to another embodiment of the present invention. Components thereof that are similar to the components in FIG. 5 are depicted with a same reference number.

In the example depicted in FIG. 5B, a square temperature sensor 102 is placed directly below the electrothermal transducer 104. In FIG. 6, by contrast, a serpentine temperature sensor 102*a* is placed directly below the electrothermal transducer 104. The square temperature sensor 102 in FIG. 5B may be formed in a flat manner of the level form of the electrothermal transducer 104, by way of the interlayer insulation film 103. Consequently, an advantage is gained in that the ink discharge from each respective nozzle is more stable. It is possible, by contrast, to significantly set the value of the resistance of the temperature sensor with the serpentine temperature 102*a* in FIG. 6, by contrast, and thus, gain an advantage of being able to detect a slight temperature change in the electrothermal transducer with a high degree of precision.

Figure 7:
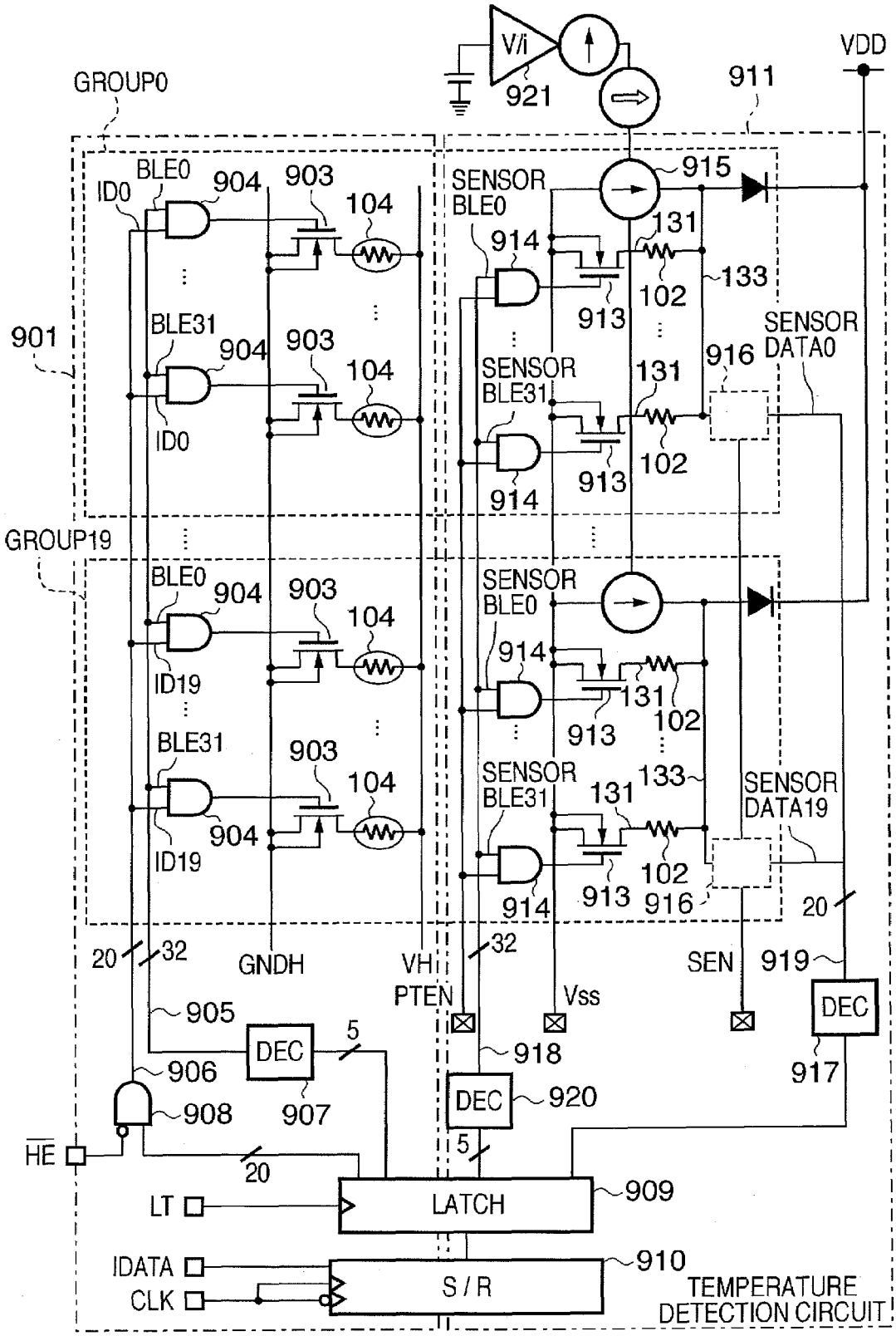
FIG. 7 is a block diagram describing an example driving circuit and a temperature detection circuit of heaters of the inkjet head according to a first embodiment of the present invention.

FIG. 7 is a block diagram describing a driving circuit and a temperature detection circuit of the electrothermal transducers (hereinafter, heaters) of the inkjet head according to the first embodiment of the present invention.

A segment includes the heater 104, a switching element 903 that drives the heater 104, and an AND gate 904, which performs an AND operation on a selection signal and an on/off signal. A total of 640 segments are partitioned in 20 groups, numbered from 0 to 19, with each group being configured of 32 segments. A configuration example of being driven in 32 blocks by 20 groups is depicted. Block Enable, or BLE, assembly of wires 905 is configured of 32-bit BLE signals, numbered BLE0 through BLE31, which each enable one segment within each respective group, i.e., simultaneously enabling 20 segments, and each of 32-bit BLE signals is wired in common to each respective group, resulting in a total of 32 blocks, with each block constituted of 20 heaters, one for each group. A driving data assembly of wires 906, which is configured of 20-bit on/off signals corresponding to data to be printed, numbered ID0 through ID19, each of the 20-bit on/off signals is wired separately to each respective group. A decoder 907 takes and decodes a five-bit block number from a latch 909, and instigates the BLE0 through BLE31. An AND gate 908 determines a length of a pulse that is supplied to each heater 104, as well as the timing by which the pulse is supplied. The AND gate 908 performs an AND operation on a Heat Enable, or HE, signal of the supplied pulse and the print data, and generates the data signal ID0 through ID19. The latch 909 and the shift register 910 obtain and store a serial data Idata, which is synchronized to CLK, supplied, serially forwarded to, and stored in, the shift register 901. Hence, the data that is stored in the shift register 910 is stored in the latch 909, using a latch signal LT that is initially outputted by the next driving block. Consequently, the corresponding heater 104 is in fact driven by the timing at which the forwarding of the data to be printed in the next block is performed, according to the initially forwarded data.

The data that is forwarded to the shift register 910 contains the block number, 0 through 31, that is driven by the data, as well as the driving data, i.e., the print data, of the heater 104 that is driven in the block, a selection data of an analog switch 916, and a switch data of the temperature sensor 102. The switch data selects the temperature sensor 102 as pertains to a temperature detection circuit 911, to be described hereinafter. Upon receipt of the number data that specifies the driving block, the decoder 907 decodes the BLE0 through BLE31, and enables one heater 104 within the 32 heaters 104 within each respective group, that is to say, a total of 20 heaters 104, simultaneously. Meanwhile, the 20-bit print data ID0 through ID19 having a pulsewidth corresponding to that of the HE pulse are supplied to each respective corresponding heater 104, which are then driven.

Initially, the 0 block, i.e., BLE=0, is driven, following in sequence by block 1, block, 2 block 3, and so on, until block 31, i.e., BLE=31, is finished, whereupon all nozzles on all of the recording element boards, if the inkjet head is configured of a plurality of recording element boards, execute a print by discharging the ink in accordance with the print data ID0 through ID19.

Included in the temperature detection circuit 911 is a switching element 913 at one terminal of the temperature sensor 102, which is connected to the wire 131, and controls an on/off setting thereto. Another terminal of the temperature sensor 102 is connected to the common wire 133 of each respective group, to which in turn is connected a plurality of the temperature sensors 102. A segment is configured of an AND gate 914 that performs an AND operation on a Block Enable (BLE) and a PTEN on/off signal, the switching element 913, and the temperature sensor 102, which form a temperature sensor group. In the present circumstance, the temperature sensor group possesses 640 of the temperature sensor 102, corresponding to the number of the heater 104. The 640 temperature sensors 102 are partitioned in 20 groups of 32 elements each, as per the driving circuit 901, forming a 32×20 matrix, with output enabled from each respective sensor. A sensor BLE assembly of wires 918 is configured of 32-bit BLE signals, numbered BLE0 through BLE31, which each enable one temperature sensor 102 within each respective group, and are wired in common to each respective group. A sensor data assembly of wires 919 is configured of 20-bit BLE signals, numbered sensor data SENSOR DATA0 through SENSOR DATA19, which each enable one group out of the 20 groups, and are wired separately to each respective group.

Within each group, a constant current source 915, which maintains a constant electric current, and an analog switch 916, which switches the output of each respective temperature sensor 102, are connected to each group. A reference current source 921 controls the value of the current of the constant current source 915. A control circuit that controls the switching element 913 and the analog switch 916 is configured of a decoder 920, which takes a sensor block number and instigates the sensor block enabling number BLE0 through BLE31, and a decoder 917, which takes the temperature sensor BLE0 through BLE31 and instigates the group enabling number sensor data SENSOR DATA0 through SENSOR DATA19.

The sensor block number that is forwarded to the serial register 910 and latched in the latch 909 is received in the Idata, and all 20 of the switching elements 913 that are affiliated with the block that is enabled by the sensor BLE0 through BLE31 are driven to an ON state. A similarly forwarded temperature sensor group number is also received, and the analog switch 916, which is enabled by the group enabling number sensor data DATA0 through DATA19 that are output by the decoder 917, is selected. An output of single temperature sensor 102, which is affiliated with the enabled group of the enabled block, is selected. The temperature data from the selected temperature sensor 102 is synchronized with the signal PTEN, and output as a voltage signal via an output terminal SEN.

Thus, the output of each respective temperature sensor 102 is selected by controlling the switching element 913, which selects an output of each temperature sensor 102, and the analog switch 916, which selects each respective group. Installing the analog switch 916 in such a fashion allows reducing the number of wires and terminals, as it will be unnecessary to have wires that directly extract the detected signal from each individual sensor of each respective temperature sensor group.

Figure 8:
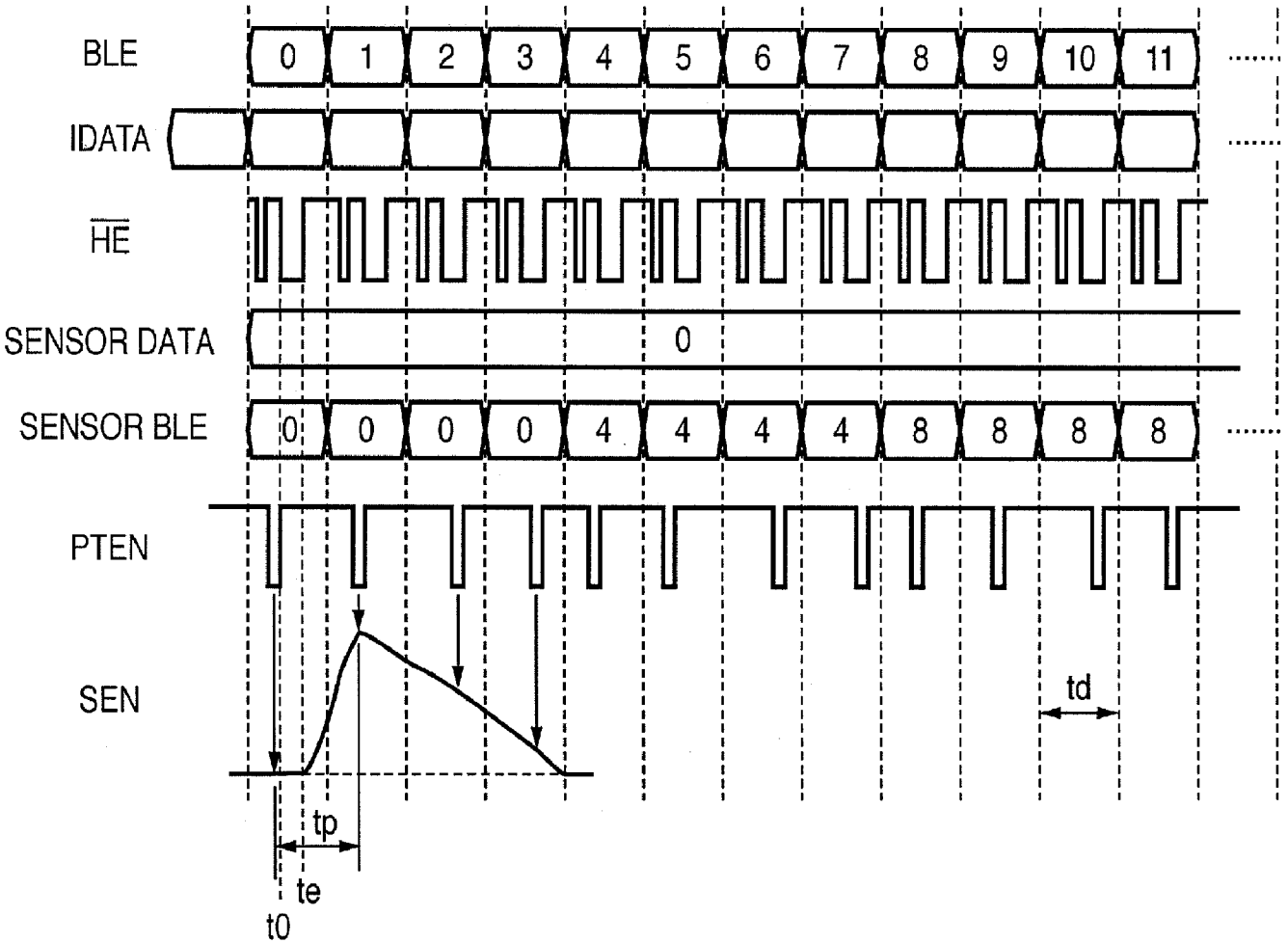
FIG. 8 is a timing chart describing an example of a timing of a control signal for driving the heater and obtaining a temperature data of the inkjet head according to the first embodiment of the present invention.

FIG. 8 is a timing diagram describing an example of a timing chart of driving the heaters 104 and a control signal for obtaining the temperature data from the temperature sensor 102.

The temperature that is detected by the temperature sensor 102 becomes a peak temperature approximately 1.2 ⌠sec after the timing ("te" in block 0) of the cessation of the driving of the heater 104. If the length of the pulse that is supplied to the heater 104, i.e., the length of the HE pulse, is 0.8 ⌠sec, then the peak temperature of the heater appears 2 ⌠sec after the timing ("t0" in block 0) of the commencement of the pulse supply. In a case that a plurality of nozzles are being driven, they would typically be driven in a time-divisional fashion, although a circumstance may arise wherein conditions may dictate a time division interval of 2 ⌠sec or less. In such a circumstance, it would not be possible to obtain the peak temperature value of the heater that is being driven by the block. Consequently, it is necessary to detect the peak temperature of the heater that is driven by the successive block while the block that is driven thereafter is being enabled, as depicted in FIG. 8, which shows an example of detecting the temperature of the heater that is driven in block 0, by setting the sensor BLE signal to "0" (BLE0 is high level) when the heaters 104 of the succeeding block 1 are enabled.

Thus, the driving of the heaters via the driving circuit 901 and the temperature detection operation via the temperature sensor 102 are not simultaneously operated. Consequently, when focusing on the temperature sensor 102 that is targeted for inspection, the temperature of the heater is detected within the enabling time of a block other than the block in which the heater is driven, by enabling the control signal of the sensor BLE and the sensor data SENSOR DATA, i.e., by enabling the analog switch 916. FIG. 8 depicts a situation wherein the peak temperature value is obtained at 2 ⌠sec (tp) after the commencement of heating of the heater, and the time division interval td of the driving of the heater is also 2 ⌠sec.

FIG. 8 depicts a timing wherein the sensor data is SENSOR DATA0, that is to say, the temperature of the heater 104 of group 0 is detected. For example, when detecting the output of the temperature sensor 102 corresponding to the heater 104 that is enabled in block 0, i.e., BLE0, of the heater 104 of group 0, the temperature of the heater is measured by the temperature sensor 102 prior to driving the heater 104, at the peak temperature thereof, and before and after an inflection point. The reason for doing so will be described in detail hereinafter, with reference to FIG. 9.

Thus, the timing by which the temperature of the heater is regulated so as to allow accurate identification of ink discharge malfunctions, even if the temperature detection attributes of the temperature sensor 102 vary with misalignment during manufacture or over the passage of time thereafter.

Figure 9:
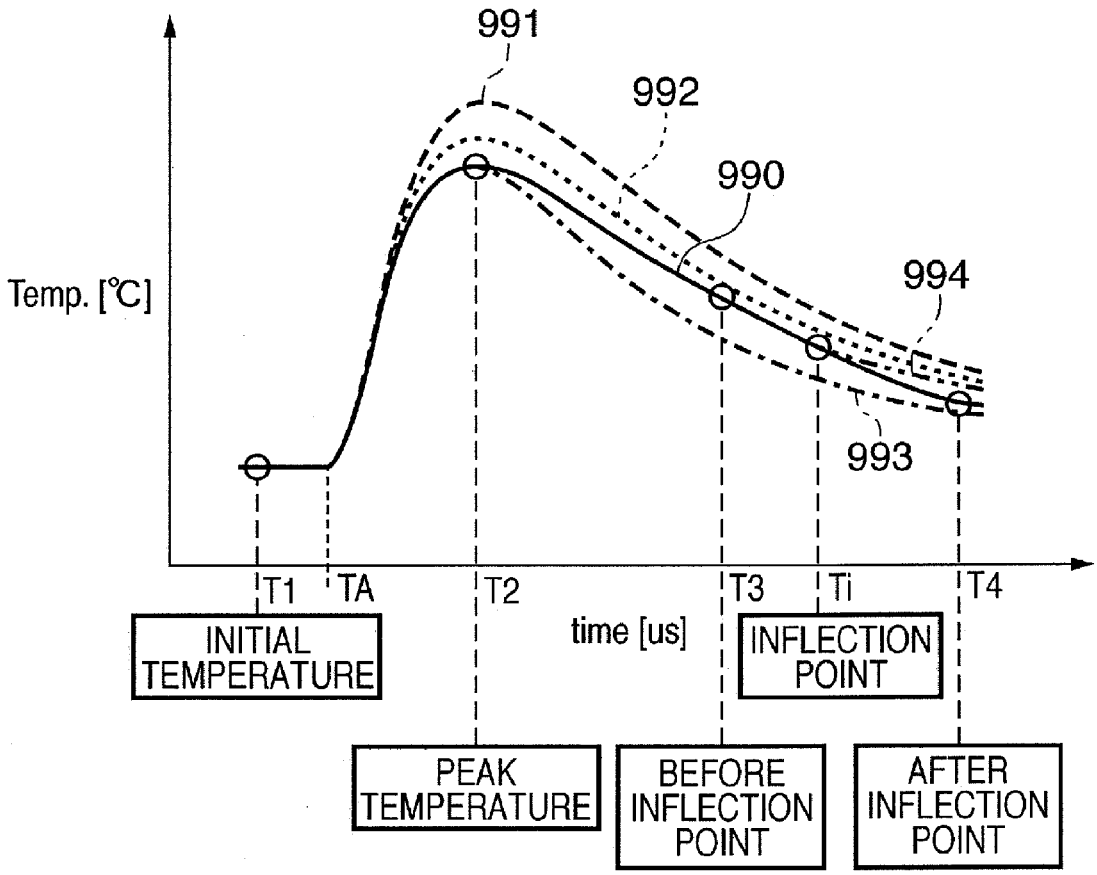
FIG. 9 depicts a graph explaining a change in an output value of a temperature sensor, both when the inkjet head properly discharges ink, and with each respective discharge fault, according to the embodiment.

FIG. 9 depicts a graph explaining a change in an output value of a temperature sensor, both when the inkjet head properly discharges ink, and with each respective discharge fault, when a 20V pulse is applied for 0.80 ⌠sec to the heater 104 for which the initial temperature is 25 C, the thickness of the interlayer insulation film 103 is 0.95 ⌠m, and the resistance is 360 ohms. The change in temperature that FIG. 9 depicts is that which results after an ink discharge operation has been performed once through.

Reference numeral 990 denotes a temperature profile when ink has been properly discharged. Numeral 991 denotes the temperature profile when a discharge fault occurs as a result of bubbles being trapped within the nozzle. Numeral 992 denotes the temperature profile when a discharge fault occurs as a result of an ink refill not being performed properly, due to impurities accumulating in the ink passage. Numeral 993 denotes the temperature profile when a discharge fault occurs as a result of ink adhering to the surface of the nozzle. Numeral 994 denotes the temperature profile when ink cannot be properly discharged as a result of impurities blocking the nozzle.

The ink discharge malfunction 991 is caused by small bubbles aggregating into larger bubbles, through a variety of causes. In such a situation, the heat generated by the heater 104 is not transmitted due to the bubbles in the ink passage. Hence, the heat cannot escape, as per the upper part of FIG. 5A, and is instead accumulated in the thermal storage layer 101. Accordingly, the temperature detected by the temperature sensor 102 will be higher at any time than that detected during proper ink discharge.

The ink discharge malfunction 992 is caused by impurities accumulating in the ink passage, such that ink refill is not completed in time for the next heat enable signal (HE) to be applied. In such a circumstance, there will be ink to one degree or another on the protect film 106. Consequently, a greater amount of heat is transmitted to the ink than would be transmitted during an ink discharge malfunction caused by bubbles. Hence, while the temperature detected by the temperature sensor 102 will be higher at any time than that detected during proper ink discharge, it will also be lower than that detected during the ink discharge malfunction 991 caused by bubbles.

In the ink discharge malfunction 993 due to ink adhering to the surface of the nozzle, upon ink jetting, a tail portion of an ink droplet becomes a droplet itself as a result of the surface tension of the ink, and a satellite or mist of ink results, rather than the kind of ink droplet that is necessary for regular printing. When the ink satellite or mist adheres to the periphery of the nozzle, it interferes with the ink discharge, and may result in such ink application malfunctions (abnormal wetting) as a misalignment of the placement of the ink droplet. In such a circumstance, ink that adheres to the nozzle surface is pulled up into the nozzle as the meniscus retreats therein. Consequently, the timing whereby the ink contacts the protect film 106 comes faster than under normal circumstances. As a result, while the temperature detected by the temperature sensor 102 will follow the same profile as that for a proper ink discharge until the ink that adheres to the nozzle surface contacts the protect film 106, the temperature so detected declines at a more rapid timing, i.e., before inflection point, than under normal circumstances. Particularly, a curve denoted by numeral 993 is lower than a curve denoted by numeral 990 after the timing T2.

In the ink discharge malfunction 994, an ink discharge cannot be properly performed because impurities clog the nozzle, or bubbles are created and grow therein. In such a circumstance, the bubbles grow and shrink, unlike that which arises from trapped bubbles or insufficient refilling. Given, however, that the nozzle is obstructed, wholly or partially, the bubbles expand into the common ink chamber. Consequently, the timing whereby the ink contacts the protect film 106 through refilling comes later than under the normal circumstances. Hence, the timing for cooling by ink refilled from the common ink chamber will vary from that under the normal circumstances. Such timing is defined as "during refilling."

Accordingly, the timing T1 prior to applying the driving pulse, the timing T2 when the peak temperature is reached, the timing T3 that is approximately 2 ⌠s before timing Ti and after timing T2, and the timing T4 that is approximately 2 ⌠s after timing Ti, are measured by the temperature sensor 102. The timing Ti indicates a timing when the ink contacts the protect film 106 and a timing corresponding to an inflection point of a temperature change in unit time. A timing TA indicates a timing at which a driving pulse is applied. Note, the timing T3 may be before the timing Ti and approximately 3 ⌠s after the timing T2. It is thus possible to determine with ease when ink is being discharged properly, and when there is an ink discharge malfunction.

Figure 10:
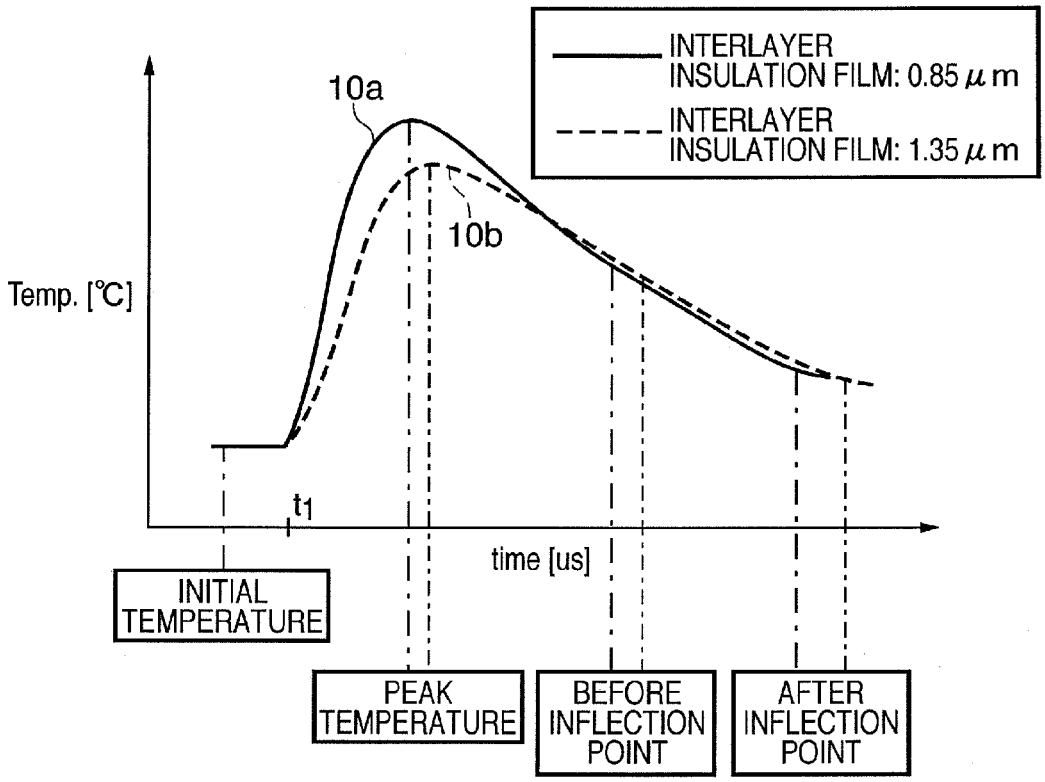
FIG. 10 depicts a graph explaining that the temperature that the temperature sensor detects pertaining to the inkjet head varies depending on a thickness of an interlayer insulation film, according to the embodiment.

FIG. 10 depicts a graph explaining how the temperature that the temperature sensor 102 detects varies depending on the thickness of the interlayer insulation film 103, when ink is properly discharged at an initial temperature of 25 C, and the thickness of the interlayer insulation film 103 is 0.85 ⌠m, per the solid line 10*a*, and 1.35 ⌠m, per the dashed line 10*b*.

As per the graph, the interval between the application of the driving pulse to the heater 104 at timing t1 and the point when the peak temperature is reached, and the interval between the peak temperature and the point where the temperature changes as the ink is refilled, is longer when the thickness of the interlayer insulation film 103 is 1.35 ⌠m, per 10*b*, than when the thickness is 0.85 ⌠m, per 10*a*. Accordingly, the timing that is suited to determining whether the ink discharge is working properly or not may be misaligned depending on the thickness of the interlayer insulation film 103. Thus, it becomes more difficult to determine accurately whether the ink discharge is working properly or not in cases where the discharge malfunction determination is made according to a fixed timing. Consequently, a recommendation is made for a process that determines whether the ink discharge is working properly or not, and which is not dependent on the thickness of the interlayer insulation film 103, according to the embodiment.

Figure 11:
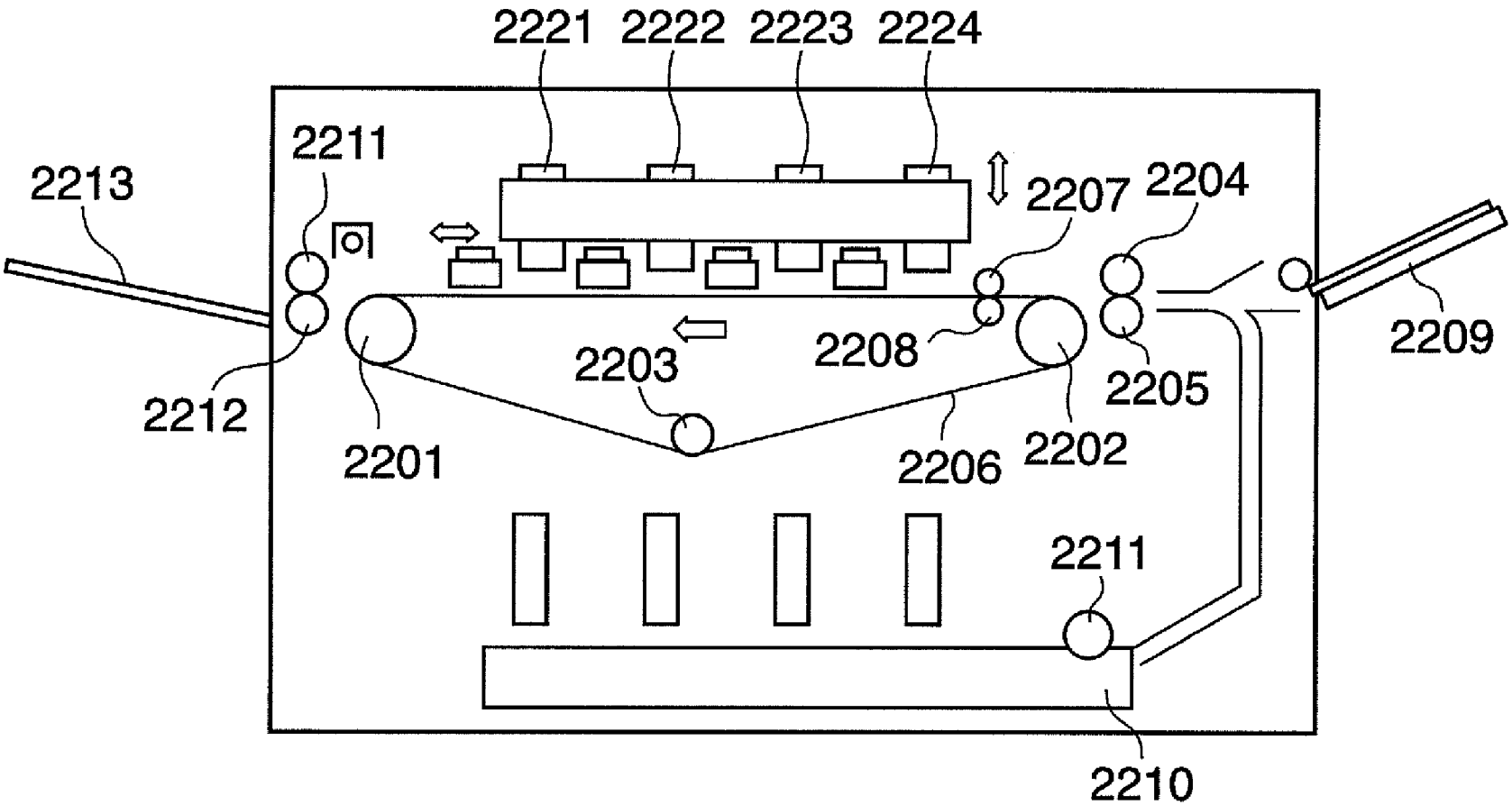
FIG. 11 depicts a view of an exemplary full multi-inkjet printer that employs the inkjet head according to the embodiment.

FIG. 11 depicts a view of an example full multi-inkjet printer that employs the inkjet head according to the embodiment. Reference numeral 2210 denotes a print paper feed cartridge. Numeral 2209 denotes a manual print paper feed. Conceivable paper feed protocols might include such as the Duplo protocol, wherein a paper feed roller 2211 and a paper separation pad are used to separate sheets of recording paper one at a time, as well as the lug and retard protocols. A sheet of recording paper supplied from the print paper feed cartridge 2210 or the manual print paper feed 2209 is brought into contact with the leading edge of a nip of resist rollers 2204 and 2205, the rotation thereof being suspended. A paper advance roller 2211 is rotated slightly in the resulting state. Slack in the sheet of recording paper between the resist roller 2204 and the paper advance roller 2211 is taken up, and a misalignment in the feed direction corrected. When a photo sensor (not shown) detects that the sheet of recording paper has come into contact with the leading edge of a nip of the resist rollers 2204 and 2205, the resist rollers 2204 and 2205 are rotated. It would be possible to print an image at a prescribed position on the sheet of recording paper by regulating the timing of the driving of the inkjet head, i.e., the driving of the heater, with the commencement of the rotation of the resist rollers 2204 and 2205 acting as a trigger thereof.

Once fed by the rotations of the resist rollers 2204 and 2205, the sheet of recording paper is clamped by a conveyor belt 2006 and a pinch roller 2207 and 2208. High voltage current is applied to the lower roller 2208 of the pinch roller 2207, and the upper roller 2207 is grounded. Thus, the sheet of recording paper that passes through the pinch rollers 2207 and 2208 will absorb static electricity as it is fed along the conveyor belt 2206. The rotation of a drive roller 2201, which is driven by a pulse motor (not shown) that is the driving source thereof, advances the conveyor belt 2206 in moving the sheet of recording paper to the print commencement position, directly below inkjet heads 2221 through 2224.

The conveyor belt 2206 is strung between the drive roller 2201, a driven roller 2202, and a pressure roller 2203. The pressure roller 2203 is attached to an end of an arm (not shown), so as to freely rotate, and the other end of the arm is attached to a casing (not shown) that swings freely. The arm applies tension to the conveyor belt 2206 by way having a spring apply pressure thereto.

Reference numerals 2221 through 2224 denote all full-line type inkjet heads, each with a plurality of nozzles arrayed thereupon that span the width of the print region of the sheet of recording paper. In order from the upstream end of the direction of the feed of the sheet of recording paper, the heads are positioned the black head 2224, the yellow head 2223, the magenta head 2222, and the cyan head 2221, spaced at specified intervals. The inkjet heads 2221 through 2224 are attached to an inkjet head holder.

In the configuration, the sheet of recording paper is adhered to the upper surface of the conveyor belt 2206, which feeds the sheet of recording paper as the sheet of recording paper is printed using the inkjet heads.

Reference numerals 2211 and 2212 denote a print paper discharge roller, the conveyor drive thereof is due to the rotational energy of the driven roller 2202, by way of a transfer device (not shown). After printing, the sheet of recording paper is pinched by the print paper discharge roller and a spur 2211, which discharge the printed sheet of recording paper to a discharge tray 2213, where the sheets are collected. Given that the spur 2211 contacts the printed surface of the printed sheet of recording paper, the edge of the surface of the spur 2211 that contacts the sheet of recording paper is sharpened, in order to minimize a shift in the ink of the printed image.

Figure 12:
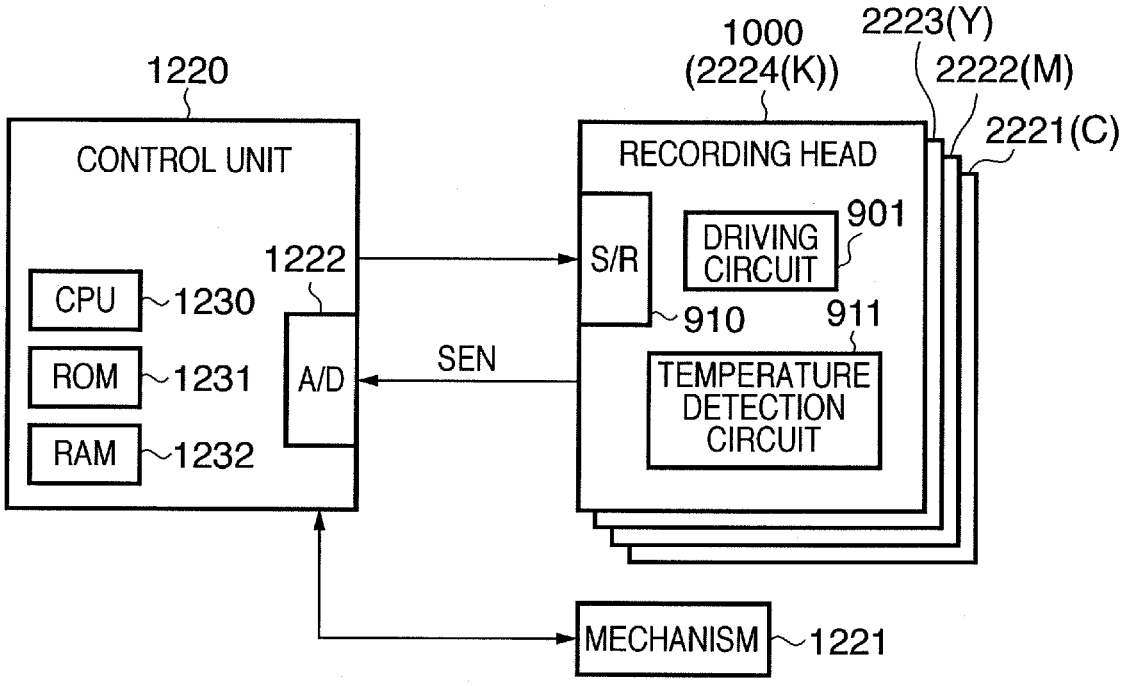
FIG. 12 is a block diagram describing an example configuration of an inkjet printer according to the embodiment.

FIG. 12 is a block diagram describing an example configuration of an inkjet printer according to the embodiment. Elements of FIG. 12 that are similar to elements in other figures are designated with identical reference numbers, and descriptions thereof are omitted.

A control unit 1220, possessing a CPU 1230, a ROM 1231 and a RAM 1232, controls the overall operation of the printer. An inkjet head 1000 is constituted to correspond to each of the black, yellow, magenta, and cyan inks, as depicted in FIG. 11. A mechanism 1221, wherein the configuration of each respective inkjet head is identical, contains feed mechanism for the sheet of recording paper, as well all types of sensors, such as a print paper sensor. An A/D converter 1222 receives the temperature data, i.e., the SEN signal, from the inkjet heads, and converts the SEN signal thus received into a digital value. The CPU 1230 controls the overall operation of the printer, according to a control program stored in the ROM 1231. The RAM 1232 is used as a working area for the CPU 1230 during control processing thereby. All types of data are temporarily stored in the RAM 1232.

Figure 13:
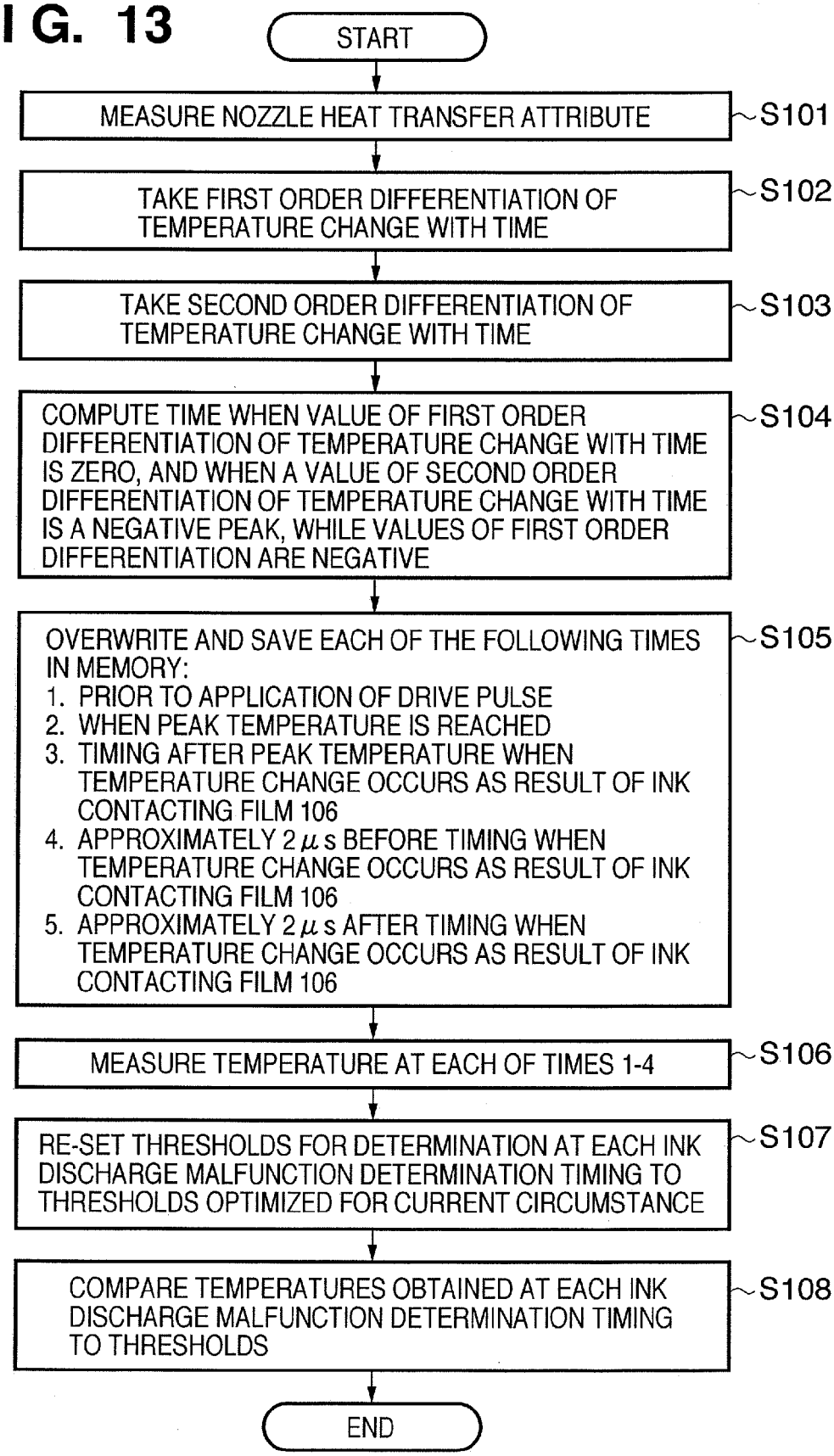
FIG. 13 is a flowchart explaining an example process according to the first embodiment.

The timing for determining whether the ink is being discharged properly, or whether an ink discharge malfunction has occurred, is set according to the chart for changing the timing for determining whether the ink is being discharged properly, or whether an ink discharge malfunction has occurred, as depicted in FIG. 13, in order that an ink discharge malfunction may be accurately detected, despite a misalignment during manufacture or over the passage of time thereafter.

FIG. 13 is a flowchart explaining a process according to the first embodiment. The program for executing the process is stored in the ROM 1231, and is executed under the control of the CPU 1230.

In step S101, an electric current is passed through the heater 104 that corresponds to a single nozzle, prior to the determination operation, and the change in temperature resulting therefrom is measured by the corresponding temperature sensor 102. The selection of the heater 104 that is applied current and heated and the selection of the temperature sensor 102, are as per the description with reference to FIG. 7. The temperature data thus gathered is input into the CPU 1230 as a digital value resulting from the conversion of the SEN signal by the analog-to-digital converter 1222. The same applies to successive temperature measurements described hereinafter.

During the interval for the measurement of the heat transfer attribute of the nozzle, either the signal PTEN is output a plurality of times with a short period, with the temperature sensor data and the temperature sensor BLE signal being fixed, or else the signal PTEN is left switched on, with the digital value that corresponds to the SEN at the time being derived and stored in the RAM 1232. It is thus possible to obtain an inkjet head temperature attribute from an initial temperature, such as depicted in FIG. 9 or FIG. 14A, for example.

Figure 14A:
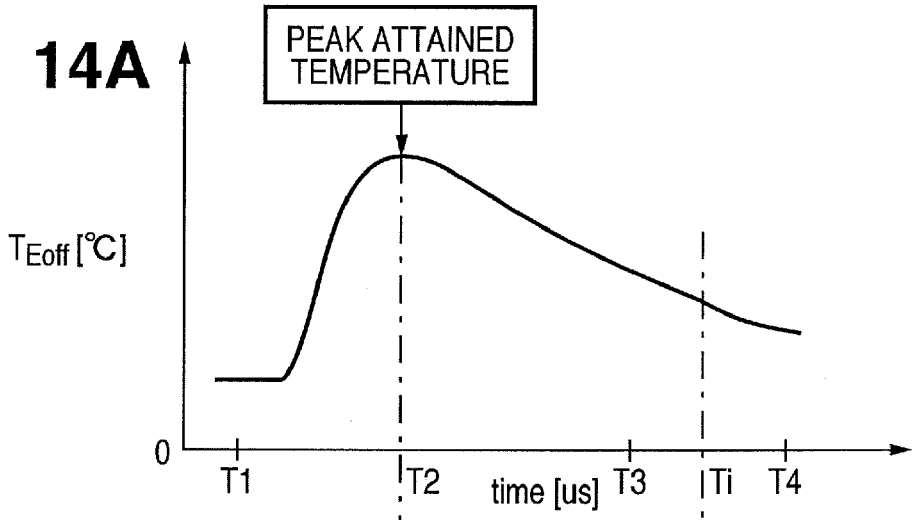
FIGS. 14A through 14C depict graphs explaining a measurement of a temperature attribute of the inkjet head according to the embodiment.

FIG. 14A depicts graphs explaining a measurement of a temperature attribute of the inkjet head according to the embodiment. The attributes are similar to those described with reference to FIGS. 9 and 10.

Figure 14B:
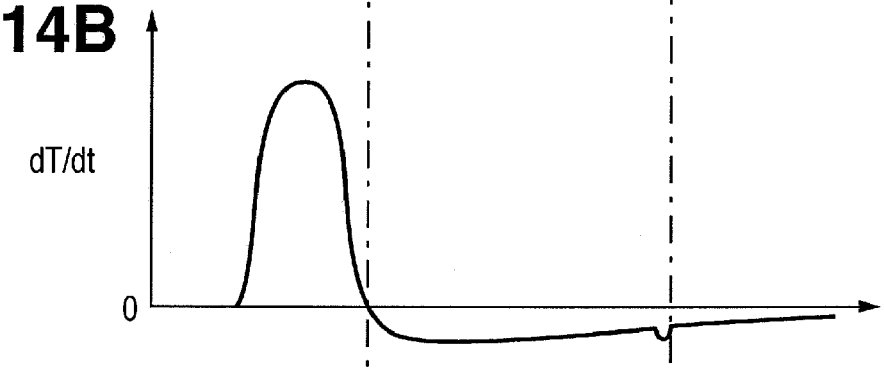

The process then proceeds to step S102, wherein a first order differentiation of the temperature changes that are measured in step S101 is obtained with respect to the duration of the measurement, and the results are outputted. FIG. 14B depicts an example of the results.

Figure 14C:
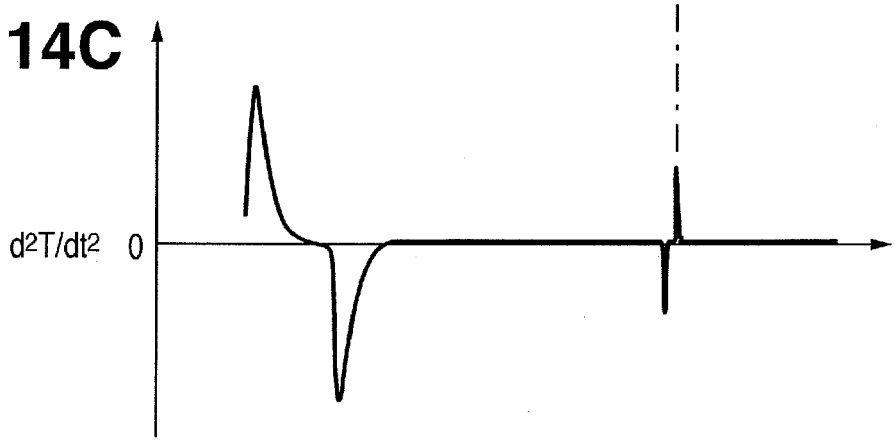

Next, the process proceeds to step S103, wherein the first order differentiation obtained in step S102 is further differentiated and the second order differential results of temperature changes with a time period are obtained. FIG. 14C depicts the results. Whereas the differentiations are taken in software according to the first embodiment, it would also be permissible to employ a differential calculator or other hardware device.

The process then proceeds to step S104, wherein the time is obtained when a value of the first order differentiation obtained in step S102 becomes 0, and the time is obtained when a value of the second order differentiation obtained in step S103 becomes a negative peak while the values of the first order differentiation obtained in step S102 are negative value. The timing at which when the value of the first order differentiation becomes 0 denotes the timing at which the temperature detected by the temperature sensor 102 reaches the peak temperature. The timing wherein the values of the first order differentiation are negative and the value of the second order differentiation is at its peak value, denotes a timing Ti at when the temperature changes as the ink contacts the protect film 106.

Then the process proceeds to step S105, wherein the following timings for obtaining the temperature data from the temperature sensor 102 are established:

1. T1, the timing prior to the application of the driving pulse of the heater;
2. T2, the timing when the peak temperature, as detected in step S104, is reached;
3. Ti, the timing when the temperature of the heater changes as the ink contacts the protect film 106 after the peak temperature;
4. T3, the timing between the timings T2 and Ti, approximately 2 ∫s before the timing Ti; and
5. T4, the timing approximately 2 ∫s after the timing Ti.

The data pertaining to each respective timing thus established is stored in the RAM 1232.

The process proceeds to step S106, wherein the temperature data for each respective timing is obtained in accordance with the timing data stored in step S105. If the temperature data for a given heater 104 is specified, the temperature for the heater 104 is measured by the corresponding temperature sensor 102 at T1, that is, prior to the application of the driving pulse. This is followed by measuring the temperatures at the timings of T2, T3 and T4.

Next, the process proceeds to step S107, wherein the thresholds of determination of each respective timing T1 through T4 are re-set, based on the temperature data measured in step S101, to thresholds that are more suited to the present circumstance. The temperature data pertaining to the measurement timing obtained in step S105, is used to establish the thresholds for determining whether or not the state of ink discharge is normal, based on the temperature data at the time. In the present circumstance, the thresholds are set to a temperature value that has a differential above or below the value that is measured at the time.

The process then proceeds to step S108, wherein the temperature data obtained by measurement at each respective timing in step S106, and the thresholds corresponding to each respective timing obtained in step S107, are respectively compared, and the state of each nozzle is determined.

According to the first embodiment, the timing by which the temperature data is obtained in order to determine whether an ink discharge malfunction has occurred or not is taken to be the timings T1 through T4, thus allowing a determination as to whether an ink discharge malfunction at each nozzle has occurred or not at each respective timing with maximum accuracy.

The change of the timing of the measurement in order to determine whether the ink is being properly discharged or not is described as being performed during a print operation, according to the first embodiment. It would also be permissible, for example, to perform the process in the interval between the end of a print of a previous line or sequence, and the commencement of the next print. It would also be permissible to do so while performing a preliminary ink discharge process in order to refresh the ink in preparation for a print.

It would also be permissible to measure the timing of the measurement in order to determine whether the ink is being properly discharged or not, according to the first embodiment, prior to leaving the factory, and store the data as timings that are optimized for the inkjet heads in the ROM 1231 or other nonvolatile memory. It would also be permissible for the user to alter the timing of the measurement at will.

It would also be permissible to automatically update the timing of the measurement when a given amount of time period has passed after the timing of the measurement is established.

Second Exemplary Embodiment

Following is a description according to a second embodiment of the present invention, which facilitates the detection of an ink discharge malfunction with a high degree of accuracy even after misalignment during manufacture or over the passage of time thereafter. The description of such configurations as the configuration of the inkjet head and the configuration of the inkjet printer will be omitted according to the second embodiment, because they are similar to those according to the first embodiment.

Figure 15:
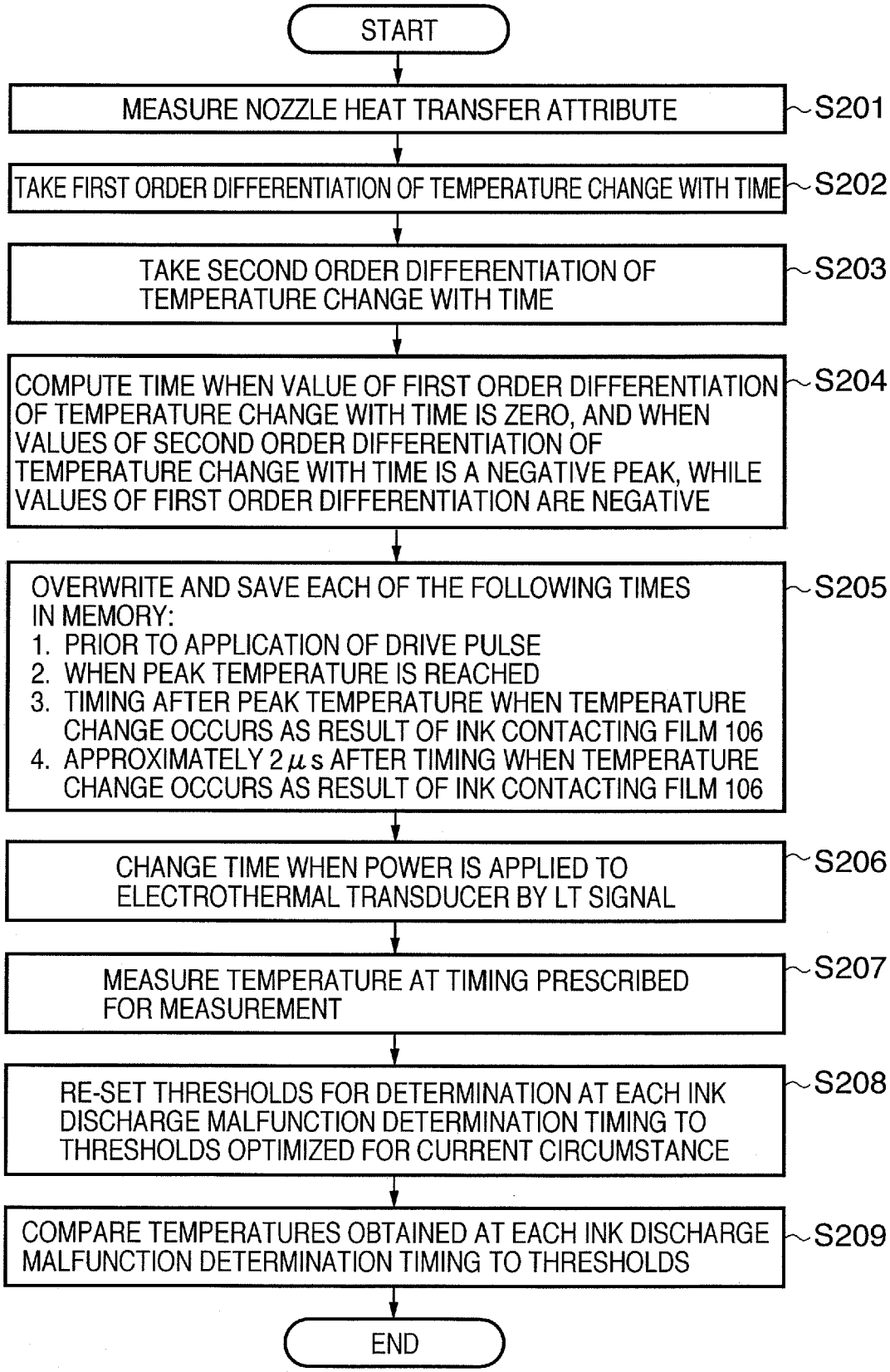
FIG. 15 is a flowchart explaining an example process according to a second embodiment.

FIG. 15 is a flowchart explaining a process according to the second embodiment. The program for executing the process is stored in the ROM 1231, and is executed under the control of the CPU 1230.

Additionally, FIG. 15, steps S201 through S205 are similar to the processes described in FIG. 13, steps S101 through S105.

In step S201, an electric current is passed through the heater 104 that corresponds to a single nozzle, prior to the determination operation, and the change in temperature resulting therefrom is measured by the corresponding temperature sensor 102. The selection of the heater 104 that applies heat and drive to the nozzle and the selection of the temperature sensor 102, are as per the description with reference to FIG. 7. The temperature data thus gathered is input into the CPU 1230 as a digital value resulting from the conversion of the SEN signal by the A/D converter 1222. The same applies to successive temperature measurements described hereinafter.

The process proceeds to step S202, wherein a first order differentiation of the temperature change measured in step S201 is obtained with respect to the duration of the measurement, and the results are outputted. The process proceeds to step S203, wherein a second order differentiation of results of the first order differentiation obtained in step S202 is obtained, and the results are outputted. Whereas the differentiations are taken in software according to the second embodiment, it would also be permissible to employ a differential calculator or other hardware device.

The process then proceeds to step S204, wherein the time is obtained when a value of the first order differentiation obtained in step S202 becomes zero, and the time is obtained when a value of the second order differentiation obtained in step S203 becomes a negative peak while the values of the first order differentiation obtained in step S202 are non-positive. The timing wherein the value of the first order differentiation becomes zero is the timing T2 at which the temperature detected by the temperature sensor 102 reaches the peak temperature. The timing T3 wherein the values of the first order differentiation are negative and the value of the second order differentiation is a negative peak, is when the temperature of the heater changes as the ink contacts the protect film 106.

Next, the process proceeds to step S205, wherein the following timings for obtaining the temperature data from the temperature sensor 102 are established:

1. T1, the timing prior to the application of the driving pulse of the heater;
2. T2, the timing when the peak temperature, as detected in step S204, is reached;
3. Ti, the timing when the temperature changes as the ink contacts the protect film 106 after the peak temperature;
4. T3, the timing between the timings T2 and Ti, approximately 2 ∫s before the timing Ti; and
5. T4, the timing approximately 2 ∫s after the timing Ti.

The data pertaining to each respective timing thus established is stored in the RAM 1232.

Thereafter, process proceeds to step S206, wherein the interval from a latch signal LT to the driving of, i.e., the supplying of current to, the heater 104, is changed such that it conforms with the optimal point for determining whether or not the nozzle slated for the determination, as is calculated in step S205, is experiencing an ink discharge malfunction, following a prescribed period of time subsequent to the latch signal LT.

Figure 16:
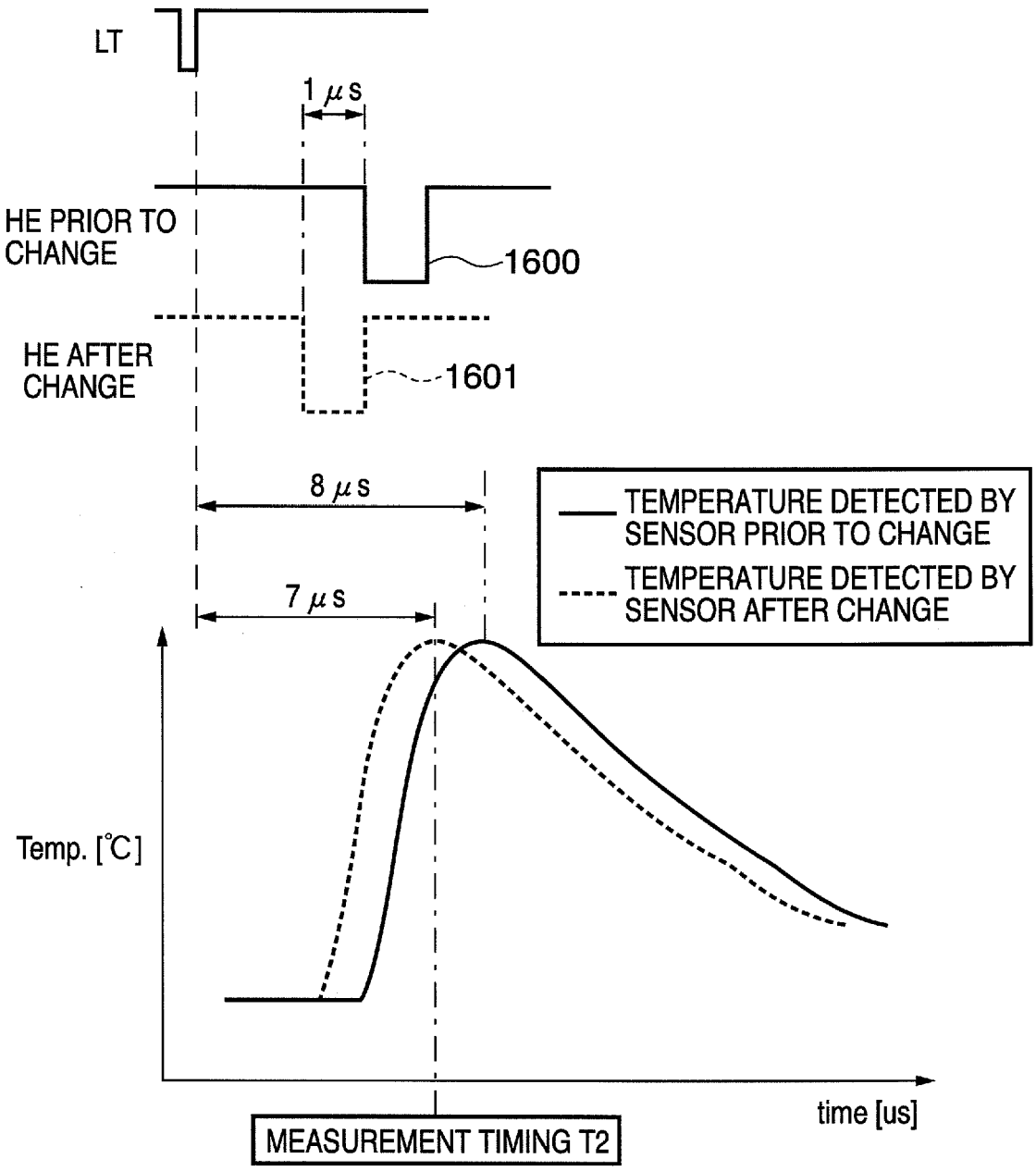
FIG. 16 depicts a view explaining an example of a heat timing according to the second embodiment of the present invention.

FIG. 16 depicts a view illustrating a variant example of timing. It is presumed that the timing of the measurement is 7.00 ∫s after the LT signal. In such a circumstance, the peak temperature and the threshold of the nozzle slated for determination are compared. It is presumed, however, that that the timing of the measurement of the peak temperature is calculated to be 8.00 ∫s after the LT signal, owing to misalignment in manufacture. In such a circumstance, it is determined that a 1.00 ∫s differential exists between the currently set timing of the measurement and the calculated timing of the measurement of the peak temperature. Hence, the interval between the latch signal LT and the supplying of current to the heater 104, i.e., the time to outputting the HE signal, is hastened by 1.00 ∫s. In the figure, numeral 1600 denotes a pre-alteration signal HE, and numeral 1601 denotes a post-alteration signal HE. Consequently, it is possible to measure the peak temperature 7.00 ∫s after the LT signal.

The process then proceeds to step S207, wherein the heat pulse signal is applied to the heater 104 at the timing that is altered in step S206, and the temperature data is obtained at the timing subsequent to the prescribed interval following the LT signal. The process proceeds to step S208, wherein the thresholds of determination of each respective timing for measurement for detecting an ink discharge malfunction are re-set, based on the temperature data measured in step S201, to thresholds that are more suited to the present circumstance. The process is performed similarly to the process in FIG. 13, step S107. The process proceeds to step S209, wherein the temperature data obtained by measurement at each respective timing in step S207, and the thresholds corresponding to each respective timing, that are obtained in step S208, are compared, and the state of each nozzle is determined.

While the prescribed measurement interval according to the first and second embodiments has been described in terms of only one point in time, it would be permissible to have a plurality of timings for measurement as well.

Figure 17A:
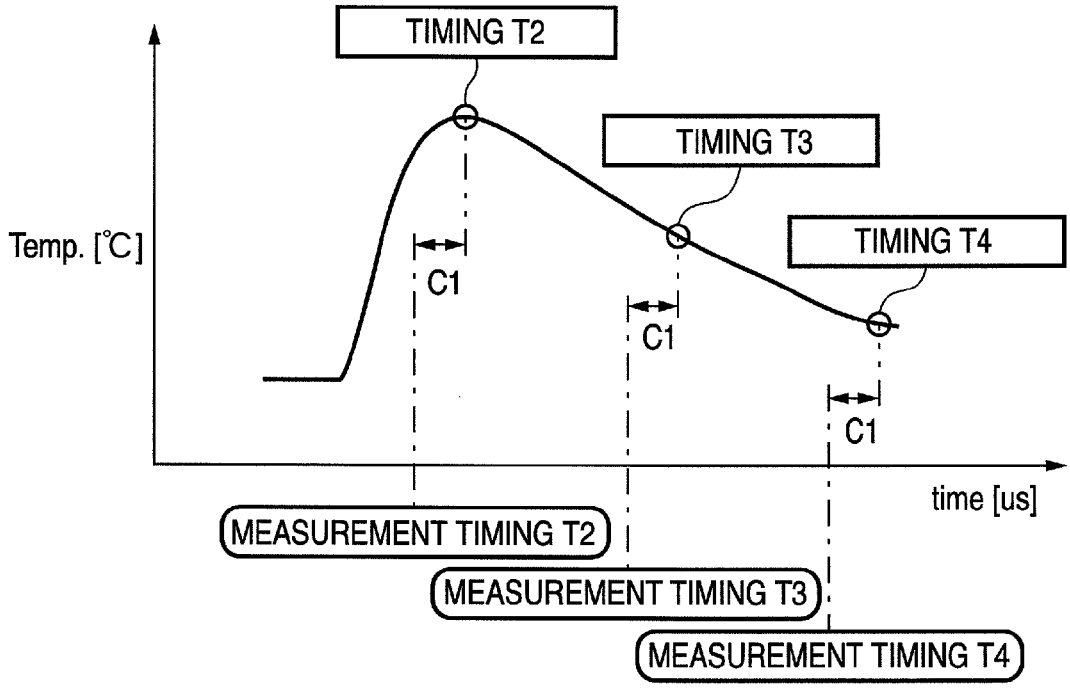
FIG. 17A and FIG. 17B depict views explaining a circumstance wherein a plurality of the measurement timings are set versus to a heater driving, according to the second embodiment.
Figure 17B:
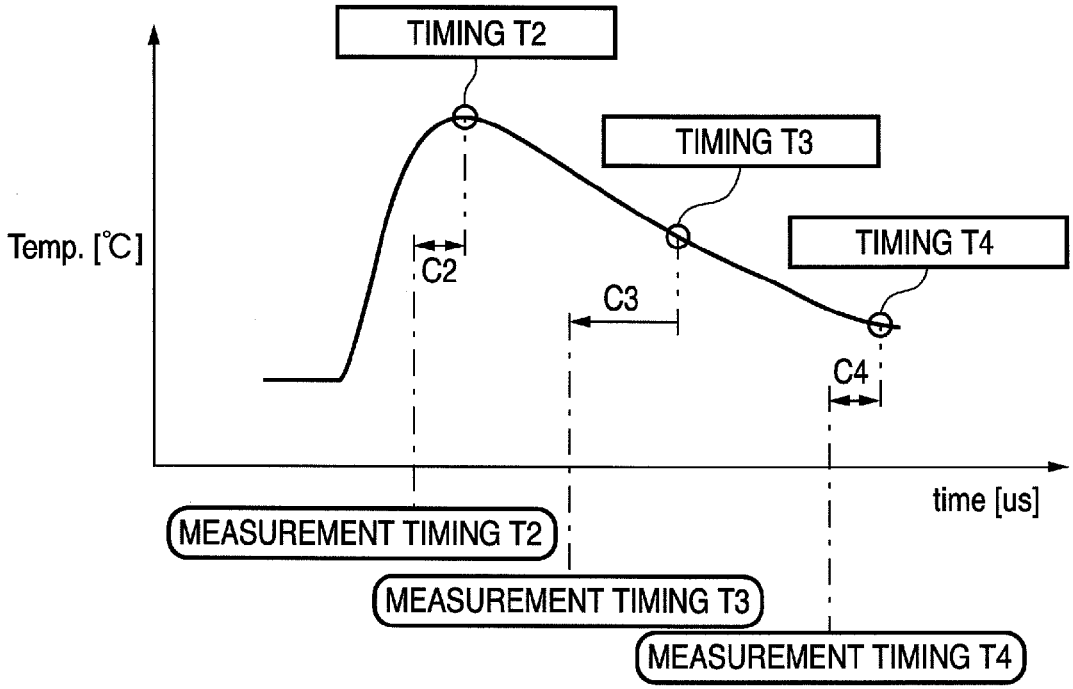

FIG. 17A and FIG. 17B depict views explaining a circumstance wherein a plurality of the measurement timings are set versus to a heater driving, according to the second embodiment.

FIG. 17A depicts an example of determining whether or not there is an ink discharge malfunction by applying a common correaction value C1 to all of the timings for measurement T2 through T4. FIG. 17B depicts a situation wherein different correaction values C2 through C4 are respectively set for the timings for measurement T2 through T4, and determinations as to whether or not there is an ink discharge malfunction are performed by obtaining the temperature data for each respective timing for measurement T2 through T4 that is corrected by each respective correaction value.

According to the first and second embodiments, it would also be permissible, for example, to determining whether or not there is an ink discharge malfunction for each respective nozzle in the interval between the end of a print of a previous line or sequence, and the commencement of the next print, in addition to doing so while performing a preliminary ink discharge process in order to refresh the ink in preparation for a print.

It would also be permissible for the process of changing the timings for measurement according to the first and second embodiments to measure the temperature prior to leaving the factory, and store the data as timings of the measurement in order to determine whether the ink is being properly discharged or not that are optimized for the inkjet heads in the ROM 1231 or other nonvolatile memory.

It would also be permissible for the user to alter the timing of the measurement at will. It would also be permissible to automatically re-set the timing of the measurement when a given amount of time period has passed after the timing of the measurement is altered.

The description according to the first and second embodiments has pertained to the inkjet printer executing the inspection method that is depicted in FIGS. 13 and 15. The present invention is not limited thereto, however. It would be permissible for a dedicated inkjet head inspection device to execute the inspection method as well. The configuration of such a device would be similar to that of the inkjet printer, at least as pertains to the inkjet head driving assembly, and thus, it would be permissible to omit a conveyor assembly for sheets of recording paper, for example. A description of the configuration of the inspection device will accordingly be omitted.

Third Exemplary Embodiment

Figure 18:
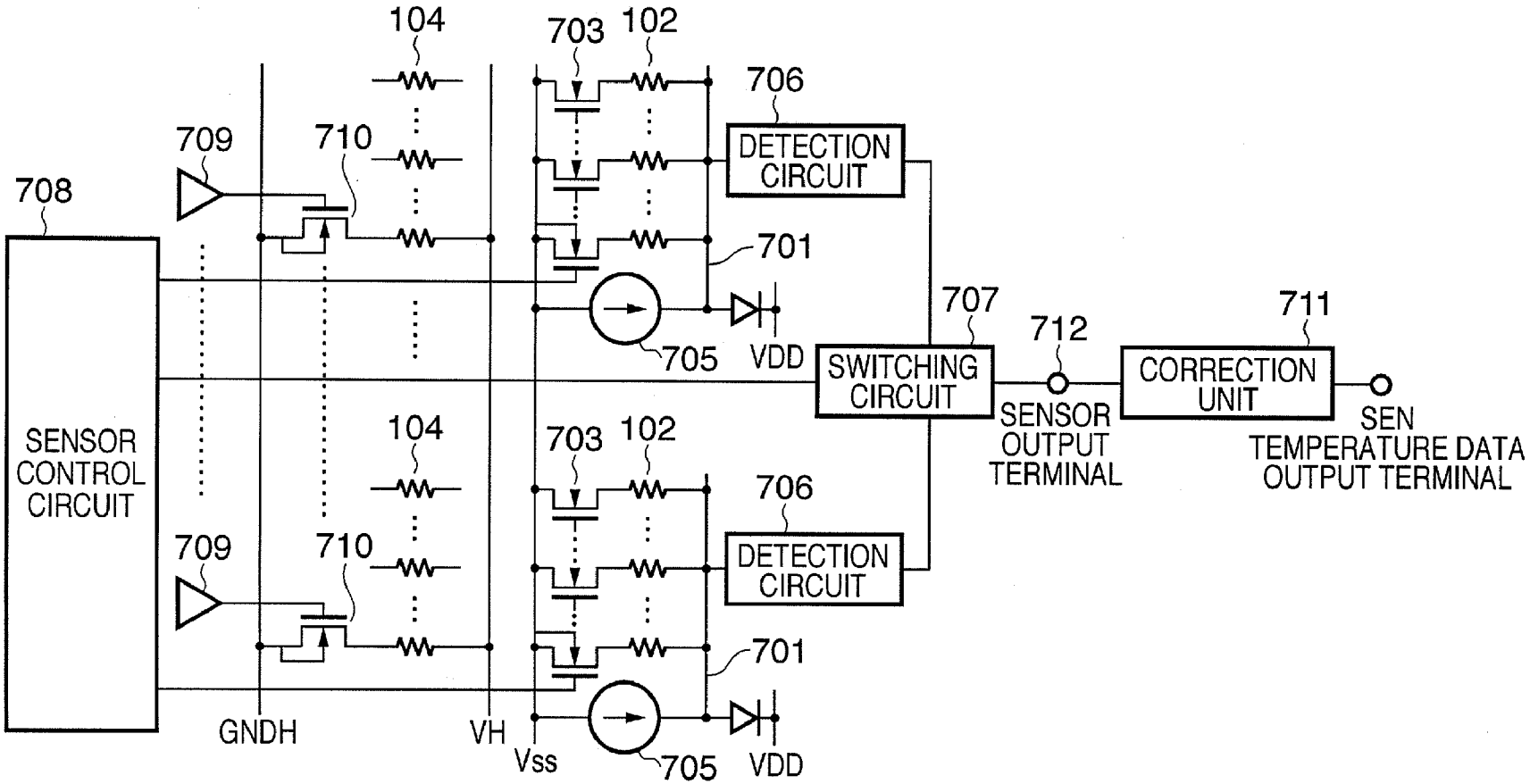
FIG. 18 depicts an example of a circuit diagram of an inkjet head according to a third embodiment of the present invention.

FIG. 18 is a circuit diagram of an inkjet head according to the third embodiment of the present invention. The circuit diagram operates in a manner fundamentally similar to the circuit depicted in FIG. 7.

The temperature sensor 102, which is positioned near to the electrothermal transducer (heater) 104, is formed of the thin film resistance. A switching device 703, which is connected to a terminal of each respective temperature sensor 102, controls whether each respective temperature sensor 102 is on or off. The other terminal of each respective temperature sensor 102 is collectively connected to a common wiring 701, which, in turn, supplies a given electric current from a constant current source 705. A plurality of detection circuits 706 each output a voltage that arises from each respective temperature sensor 102. A switching circuit 707 selects the output of the detection circuit 706, and outputs the output thereof to a sensor output terminal 712. A sensor control circuit 708, controls switching on the part of the switching devices 703 and the switching circuit 707, in order that the temperature data that is detected by each temperature sensor 102 is outputted. The detection circuit 706, the switching circuit 707, and the temperature sensor control circuit 708 are configured in a manner similar to that of the analog switch 916 and the decoders 917 and 920 in the example in FIG. 7.

The value of a temperature sensor output terminal 712, which is a temperature output terminal of the temperature sensor 102 that is selected by the temperature sensor control circuit 708, such as the analog switch, is corrected by a corrector 711 and outputted by a temperature data output terminal SEN. A heater control circuit 709 controls the switching of the switching element 710 that is connected to each respective heater 104, synchronizing with the image data or the heat signal HE, among other possibilities, and sends power to each corresponding heater 104. The heater control circuit 709 corresponds to the driving circuit 901 in FIG. 7.

Figure 19A:
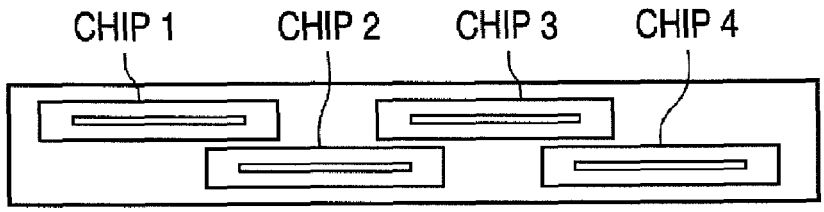
FIG. 19A depicts a view illustrating a configuration of the inkjet head according to the third embodiment.

FIG. 19A depicts a view illustrating a configuration of the inkjet head according to the third embodiment. A plurality of the inkjet head boards, chip 1 through chip 4, are positioned atop a support unit made of aluminum or other material. The number, arrangement, or other aspect of the chips are not limited to the present embodiment. The configuration of the circuit of each respective chip is, for example, a circuit configuration such as that depicted in FIG. 7 or FIG. 18.

Figure 19B:
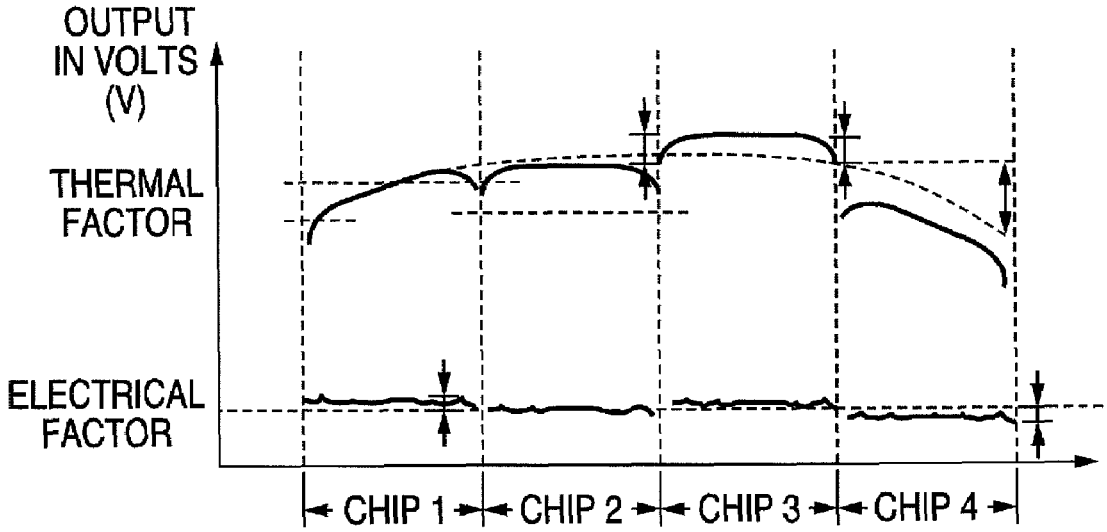
FIG. 19B depicts a view explaining an output pertaining to an output terminal of each respective sensor, and a misalignment thereof, pertaining to the inkjet head depicted in FIG. 19A.

FIG. 19B depicts a view explaining an output pertaining to an output terminal of each respective sensor, and a misalignment thereof, pertaining to the inkjet head depicted in FIG. 19A.

Each respective temperature sensor output is capable of deriving from the product of the sum of the resistance when the switching device 703 is switched on and the resistance of the temperature sensor 102, and the electric current that is supplied via the constant current source 705. The temperature that is detected by the temperature sensor 102 can, in turn, be derived from the temperature coefficient of the resistance Rs of the temperature sensor. The factors in the misalignment of the temperature sensor output of each unit can be categorized as electrical or thermal. The following are possible factors in misalignment of the electrical variety:

1. Misalignment of the electrical current in the constant current source 705;
2. Misalignment of the resistance Rs, owing to the size, film thickness, or quality of the temperature sensor 102; and
3. Misalignment of the electrical current from the constant current source 705, owing to the resistance when the switching device 703 is switched on and the resistance of the wiring.

The following are possible factors in misalignment of the thermal variety:

1. Misalignment owing to the thickness, or quality of the interlayer insulation film 103; and
2. Misalignment of temperature caused by resistance affected by the size or shape of the heater 104.

Other possible types of electrical and thermal misalignment include:

1. Misalignment Caused by the Positional misalignment of the temperature sensors on the chip;
2. Misalignment between chips, arising from the positions of the inkjet head boards within the inkjet head; and
3. Other Generalized Electrical or Thermal misalignment in addition to the misalignment between inkjet head boards.

It is of course important to eliminate electrical and thermal misalignment. Efforts are being made in this regard in the design and production processes. Misalignment of these sorts inevitably occur in manufacturing, however, and the presence of such misalignment makes accurate detection of temperature data impossible.

Figure 20:
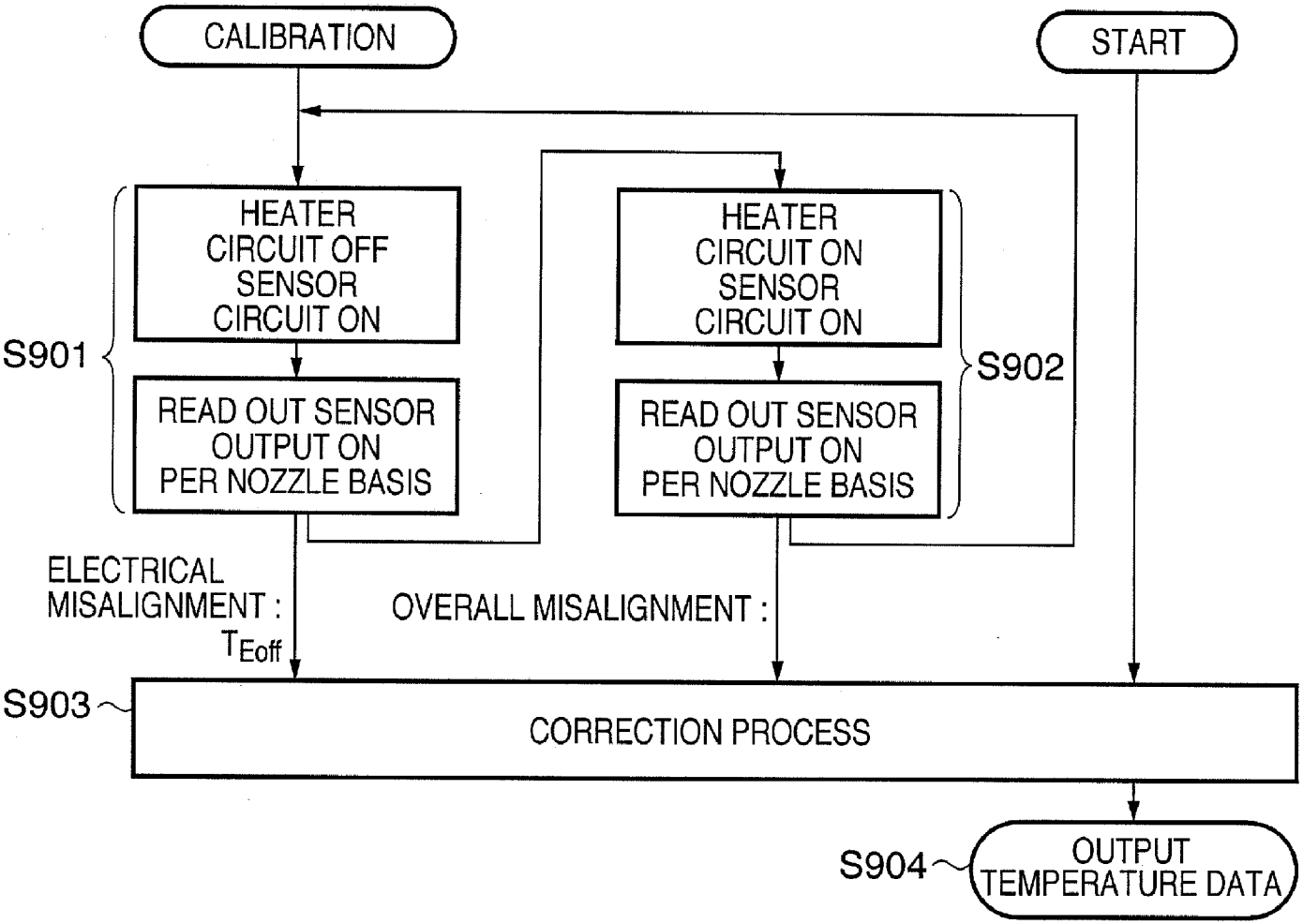
FIG. 20 is a flowchart describing a calibration process of the inkjet head according to the third embodiment.

FIG. 20 is a flowchart describing a calibration process of the inkjet head according to the third embodiment. The program for executing the process is stored in the ROM 1231 of the control unit 1220, and is executed under the control of the CPU 1230.

In step S901, i.e., the first process, the output of the temperature sensor 102 is read out, with the heater 104 switched off. In step S902, i.e., the second process, the output of the temperature sensor 102 is read out, with the heater 104 switched on. The correaction process in step S903 reads in the values read out in steps S901 and S902 to derive the electrical and thermal misalignment therefrom. The correaction process in step S903 corresponds to the process pertaining to process by the corrector 711 in FIG. 18. The temperature data outputted from the temperature sensor 102 is corrected, in accordance with the electrical and thermal misalignment so derived. Thus corrected, the temperature data is outputted as the temperature data that is detected by way of the temperature sensor 102, per step S904. While the corrector 711 is depicted as being contained in the inkjet head configuration according to the embodiment, the present invention is not limited thereto. The control unit 1220 may include the corrector 711.

Each respective nozzle of the inkjet head comprises a heater 104 and a temperature sensor 102, according to the embodiment. Ink is discharged via the nozzle when the ink in the nozzle is heated as a result of electric current being passed through the heater 104.

In step S901, according to the third embodiment, the above described electrical misalignment, i.e., misalignment caused by the positional misalignment of sensors in each chip, and misalignment caused by the positional misalignment of chips within the inkjet head, arising from the electrical misalignment between chips, is detected. Such misalignment is detected within the range of the electrical misalignment, centering on a reference value Ta, which is the temperature that is detected by the temperature sensor 102 when the heater 104 is off; hereinafter "room temperature reference value." The electrical misalignment in each respective nozzle thus detected is stored in the corrector 711.

In step S902, the misalignment between the thermal misalignment of the inkjet heads, i.e., misalignment caused by the positional misalignment of the chips, and misalignment caused by the positional misalignment of chips within the inkjet head, is detected centering on a target reference value Tg, the temperature that is detected by the temperature sensor 102 when the heater 104 is on; hereinafter "increased temperature reference value".

The overall misalignment, in accordance with the electrical misalignment Teoff and the thermal misalignment K of each respective nozzle, is stored in the corrector 711. It would be permissible for the value thus stored to be the measured value Tt as well.

Thus, the electrical and thermal misalignments are corrected and the reference value is determined in order to judge the state of the inkjet heads.

Reading out the correaction value for correcting electrical and thermal misalignment allows the manufacturer to easily perform a calibration at time of shipment from the factory. It would also allow a user to perform a calibration during use, for example, by automatically obtaining the corrected values when the device is being activated, or between sheets of printing paper, during a print job. It is thus possible to detect the temperature for each respective nozzle within the inkjet head with a high degree of precision, even if changes arise in the inkjet head attributes due to electrical or thermal misalignment.

FIG. 21 depicts a view explaining the electrical misalignment and an overall misalignment that are stored in a correaction unit, according to the third embodiment.

Following is a description of an example using the room temperature reference value Ta, immediately prior to the ink discharge, and the target increased temperature reference value Tg, which is assumed to be reached a given amount of time after the ink discharge.

While the room temperature reference value Ta is presumed to be 10 C, 25 C, or 40 C, it is permissible to set the value even more finely. While the increased temperature reference value Tg is described as the target temperature value at a point in time a designated amount of time following the ink discharge drive, it is permissible to set the increased temperature reference value for more points in time. The increased temperature reference value Tg is established by the voltage and the pulsewidth that are applied to the heater 104.

In step S901, the temperature data that is detected by the temperature sensor 102 that corresponds to each respective nozzle is read out in a constant temperature state, for example, the room temperature reference value Ta=25C. The difference between the temperature data and the room temperature reference value Ta is the electrical misalignment TEoff.

In step S902, a pulse of 18V and 0.8 ⌠sec pulsewidth is applied to the heater 104 of the inkjet head whereupon the temperature sensor 102 is positioned, by way of the interlayer insulation film 103, as depicted in FIG. 5A. After 2 ⌠sec from the timing at which the heater 104 is switched on, the inkjet head temperature measurement value Tt is detected and stored for a given condition, for example, a normal ink discharge state.

As is already clear, the measurement value Tt is an overall misalignment, containing the electrical misalignment TEoff and the thermal misalignment K, the latter being detected by the temperature sensor 102 when electric current is applied to the heater 104.

It is desirable that the thermal misalignment K and the electrical misalignment TEoff that are measured and derived be stored in an EEPROM (not shown) or other nonvolatile storage, rather than the RAM 1232.

As per the foregoing, the electrical misalignment TEoff and the thermal misalignment K of each respective nozzle are stored into a data table, and used as the correaction values when overwriting the data on the actually measured temperature. It is thus possible to obtain the temperature data for each respective nozzle of the inkjet head with a high degree of precision.

Using the temperature data or the threshold data when performing the determination of the ink discharge malfunction detection on a per nozzle basis, as well as the temperature data for controlling the change in ink discharge quantity that occurs on a per nozzle basis, allows detecting the ink discharge malfunction and controlling the ink discharge quantity with a high degree of precision.

According to the third embodiments, the time required to measure a one-inch chip with a 1200 dpi resolution, for example, with two points being measured every 2 ⌠sec, is 1200 dots×2 ⌠sec=4.8 msec. Hence, it is possible to measure and store the temperature of each respective nozzle in a very short period of time, even with inkjet heads that contain a large number of nozzles, and to calibrate the temperature data for each respective nozzle based on the measured temperatures.

The electrical misalignment TEoff that is obtained in step S901, i.e., the first process, is dependent on the electrical misalignment that has such causes as the resistance of the wiring or the attributes of the circuits, as pertains to the calibration when changing the temperature condition. Our own review indicates that it is possible to reuse the 25 C measured value for the electrical misalignment TEoff. It would also be permissible, however, to perform another measurement using the foregoing method, and store and calibrate the result, taking into account the temperature attribute of the electrical misalignment TEoff.

A variety of combinations are possible regarding the setting of the timing of the reading out of the first and second processes, with regard to the embodiment. It would be permissible, for example, for the manufacturer to carry out the first process at time of shipment, and for the second process to be carried out while in use by the end user, for example, automatically, either when the device is activated or between sheets of printing paper, during a print job. It would also be permissible for both the first and second processes to be carried out by the manufacturer, at time of shipment, as well as while in use by the end user.

With regard to the description of the electrical and thermal misalignment, only one or the other of the plus or the minus misalignment vis-à-vis the reference value has been represented. Naturally, however, it would be possible to handle both the plus and minus misalignment in similar fashion, yielding a similar effect.

According to the third embodiments, the output of the temperature sensor 102 is read out while the heater 104 of the inkjet head is off. Then the output of the temperature sensor 102 is read out while the heater is on. It is possible to use the values thus read out to correct the output of the temperature sensor.

Hence, it is possible to obtain the temperature data with a high degree of precision, corrected for both electrical and thermal misalignment, when detecting the temperature in the vicinity of the heater on a per nozzle basis, and using the data in determining the ink discharge state of the inkjet head, or in controlling the ink discharge quantity.

A line-type of inkjet head is particularly capable of offering an inkjet head with high quality image and product quality, while also being inexpensive, reliable, and packaged in a small form factor, as well as an inkjet print apparatus that employs the inkjet head. The resulting industrial and manufacturing effects are thus highly significant.

Further, according to the third embodiment, it is possible to perform the calibration with ease on the part of the manufacturer, at time of shipment. It is also possible to obtain the corrective value while in use by the end user, for example, automatically, either when the device is activated or between sheets of printing paper, during a print job. Consequently, it is possible to detect the temperature data with a high degree of precision, even if there are electrical or thermal changes in the attributes of the inkjet head. It is thus possible to perform a detection of an ink discharge malfunction, or to perform a control of a quantity of ink discharge, with a high degree of precision.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2006-169381, filed Jun. 19, 2006, which is hereby incorporated by reference herein in its entirety.

What is claimed is:

1. A recording apparatus for recording an image using a recording head that affects ink with thermal energy from a plurality of electrothermal transducers to discharge the ink via nozzles, wherein the recording head includes a plurality of temperature sensors, each of which is respectively positioned in correspondence with each electrothermal transducer; and a temperature detection circuit configured to select each one of the plurality of temperature sensors and obtain temperature data detected by the selected temperature sensor; the recording apparatus comprising:

a first temperature detection unit, in a state that a first electrothermal transducer is not driven with an electric current, configured to obtain first temperature data that the temperature sensor corresponding to the first electrothermal transducer detects by way of the temperature detection circuit;

a second temperature detection unit, in a state that the first electrothermal transducer is driven with an electric current, configured to obtain second temperature data that the temperature sensor corresponding to the first electrothermal transducer detects by way of the temperature detection circuit;

an acquisition unit that acquires correction data for correcting the temperature data that the temperature sensor corresponding to the first electrothermal transducer detects, based on the first and the second temperature data obtained by the first and second temperature detection units; and a correction unit configured to correct the temperature data the temperature sensor corresponding to the first electrothermal transducer detects, in accordance with the correction data acquired by the acquisition unit.

2. The apparatus according to claim 1, wherein the temperature sensor corresponding to the electrothermal transducer is formed of a thin film resistance, directly beneath the electrothermal transducer, by way of an interlayer insulation film.

3. The apparatus according to claim 1, wherein the temperature detection circuit comprises:

a switching element, connected to a terminal of the temperature sensor, configured to control flowing an electric current to the temperature sensor;

a constant current source configured to supply a constant current via a common wiring that is connected in common to another terminal of the temperature sensor; and a voltage detection unit configured to detect a voltage that arises in the temperature sensor from the constant current supplied by the constant current source.

4. The apparatus according to claim 1, wherein the recording head further comprises a memory for storing the correction data acquired by the acquisition unit.

5. A recording head for affecting ink with thermal energy from an electrothermal transducer to discharge the ink via a nozzle, the recording head comprising:

a plurality of temperature sensors, each of which is respectively positioned in correspondence with each electrothermal transducer;

a first temperature detection unit, in a state that respective one of electrothermal transducers is not driven with an electric current, configured to obtain first temperature data that the temperature sensor corresponding to the respective one of electrothermal transducers detects by way of the temperature detection circuit;

a second temperature detection unit, in a state that the respective one of electrothermal transducers is driven with an electric current, configured to obtain second temperature data that the temperature sensor corresponding to the respective one of electrothermal transducers detects by way of the temperature detection circuit;

an acquisition unit that acquires the first and second temperature data corresponding to the plurality of temperature sensors and acquires correction data for correcting the temperature data that the temperature sensors corresponding to the respective electrothermal transducers detect, based on the first and the second temperature data, wherein the correction data is acquired with respect to each of the plurality of temperature sensors;

a storage unit configured to store the correction data acquired by the acquisition unit; and a correction unit configured to correct the temperature data detected by each of the plurality of temperature sensor in accordance with the correction data stored in the storage unit.

6. The recording head according to claim 5, wherein the recording head is an inkjet head having a support unit on which a plurality of recording chips, each comprising a plurality of nozzles, are mounted in parallel with a line of the nozzles.

* * * * *